US012601559B2

(12) United States Patent
Dovenberg

(10) Patent No.: US 12,601,559 B2
(45) Date of Patent: Apr. 14, 2026

(54) FOLDING FIREARM STOCK AND RELATED METHODS

(71) Applicant: Hayden Dovenberg, Oregon City, OR (US)

(72) Inventor: Hayden Dovenberg, Oregon City, OR (US)

( * ) Notice: Subject to any disclaimer, the term of this patent is extended or adjusted under 35 U.S.C. 154(b) by 0 days.

(21) Appl. No.: 19/093,912

(22) Filed: Mar. 28, 2025

(65) Prior Publication Data

US 2025/0321077 A1 Oct. 16, 2025

Related U.S. Application Data

(60) Provisional application No. 63/632,418, filed on Apr. 10, 2024.

(51) Int. Cl.
*F41C 23/04* (2006.01)
*F41C 23/16* (2006.01)

(52) U.S. Cl.
CPC ..... *F41C 23/04* (2013.01); *F41C 23/16* (2013.01)

(58) Field of Classification Search
CPC ..... F41C 23/04; F41C 23/16; F41C 23/10; F41C 23/12; F41C 23/14; F41C 23/22
USPC ..... 42/71.01, 73, 1.09
See application file for complete search history.

(56) References Cited

U.S. PATENT DOCUMENTS 3,267,600 A * 8/1966 Ryan ..... F41C 3/08 42/1.09
3,618,249 A * 11/1971 Grandy ..... F41C 23/04 42/72
4,625,621 A * 12/1986 Warin ..... F41C 9/02 89/196
5,924,233 A * 7/1999 Strobel ..... F41C 23/12 42/72
7,698,848 B1 * 4/2010 Bentley ..... F41C 23/04 42/73
8,464,458 B2 * 6/2013 Chvala ..... F41C 23/20 42/73
2009/0277066 A1 * 11/2009 Burt ..... F41A 3/66 89/1.4
2013/0036645 A1 * 2/2013 Chvala ..... F41C 23/20 42/73
2015/0013203 A1 * 1/2015 Lopiccolo ..... F41C 23/04 42/73

* cited by examiner

*Primary Examiner* — John Cooper
(74) *Attorney, Agent, or Firm* — Kolitch Romano Dascenzo Gates LLP

(57) ABSTRACT

Stocks for a rifle or other firearm transition between a deployed configuration and a stowed configuration. In the stowed configuration, a buttstock of the stock is positioned to at least partially surround the scope within an internal volume of the buttstock. The buttstock covers at least a portion of the rifle scope without needing to contact the scope, and is rigid enough to protect the scope from impacts. When the firearm is ready to be used, the stock may be deployed to reveal the scope and the stock may be positioned to serve in a conventional manner for the user to rest their shoulder against. To fold or unfold the stock, a grip and buttstock of the stock are rotated with respect to a forestock of the stock. Systems include both such a folding stock and a rifle or other firearm to which the stock is coupled.

20 Claims, 35 Drawing Sheets

FOLDING FIREARM STOCK AND RELATED METHODS

RELATED APPLICATION

This application claims priority to U.S. Provisional Patent Application No. 63/632,418, which was filed on Apr. 10, 2024, and is entitled "FOLDING FIREARM STOCK AND RELATED METHODS," the complete disclosure of which is incorporated herein by reference in its entirety.

FIELD

The present disclosure relates generally to firearm stocks and more particularly to firearm stocks that may be positioned to protect a firearm scope.

BACKGROUND

A gunstock, often referred to simply as a "stock," is a part of a long gun (e.g., a rifle) that provides structural support, and to which the barrel, action, and firing mechanism are attached. A user can also brace their shoulder against the stock when firing the gun to stabilize the gun during aiming and/or transmit recoil forces into the user's body. In hunting or other long range shooting fields, scopes are often used with the gun to lend precision in aiming. These scopes contain series of lenses used for magnification, and often some type of reticle (e.g., a crosshair pattern) to indicate where the bullet should impact. Because of this, scopes tend to be delicate and can result in poor aim and missed shots when the scope is damaged or misaligned. Hunters and other users often travel on foot over rough, backcountry terrain and/or through brush, and generally carry their rifles strapped to the outside of a specialized backpack, or over their shoulder in a sling, when traveling this terrain. This positioning often puts the rifle up against the backpack, which can cause scope turret settings to be inadvertently changed by rubbing against the outside of the pack. Even scopes with turret locks can be subject to the locks being inadvertently disengaged. Having complete confidence that one's rifle scope is precisely accurate is essential in making an ethical shot on an animal. Because achieving the necessary precision is impractical in the field if one were to remove the scope for travel and attempt to replace the scope on the rifle in the field, and because the scopes are subject to potential damage and/or inadvertent setting adjustments from impacts, rubbing, or scratches while traveling, users often attempt to protect the scope when the rifle is not in use.

Existing strategies for protecting scopes include scope caps (e.g., flip-up covers) placed on the ends of the scope, fabric scope covers (e.g., neoprene sleeves or "socks," or other covers that work like a fitted sheet around the scope), and elastic self-adhesive tape (often referred to as "vet tape" or "form tape") wrapped around the scope. However, these prior art devices and solutions fail to provide sufficient protection from impacts, inadvertent settings adjustments, and items resting on the scope while in a pack, inside a vehicle, or just on slung on shoulder. There thus remains a need for an improved device to protect rifle scopes while they are carried and/or transported.

SUMMARY

Presently disclosed stocks for firearms, such as rifles and other long guns, may be configured to address the above discussed and other issues with the prior art, and may be configured to be sold as an aftermarket stock with variations that can be installed on a wide variety of different firearms. Stocks according to the present disclosure may be configured to fold (thereby reducing the length of the firearm) or otherwise positioned to cover the scope without contacting the scope, and may be rigid enough to buffer and protect the scope from impacts, scratches, wear on the lenses, and inadvertent scope turret settings adjustments. Disclosed stocks also may be configured to protect the scope from items resting on the scope while in a pack, inside a vehicle, or in a sling. In some examples, disclosed stocks are configured to protect the scope as if the firearm was stored inside a hard gun case, while providing the portability of a folded stock firearm. When the firearm is to be used, the stock may be deployed (e.g., unfolded) to reveal the scope, and the stock may be positioned to serve in a conventional manner for the user to rest a shoulder and/or a cheek against.

In an example, a stock for a rifle may include a forestock (which also may be referred to as a "fore-end") configured to engage with a rifle action of the rifle, a grip pivotally coupled to the forestock, and a buttstock. The buttstock may define an internal volume between a first sidewall and a second sidewall. The stock may be configured to be selectively transitioned between a deployed configuration and a stowed configuration. In the deployed configuration, the buttstock is engaged with the grip; while in the stowed configuration, the buttstock is disengaged from the grip (e.g., not directly coupled to the grip), engaged with the forestock, and positioned such that the internal volume opens towards the forestock, such that the buttstock is configured to at least partially surround a scope of the rifle. Disclosed systems include both a folding stock and a rifle or other firearm to which the folding stock is coupled. Disclosed methods may include disengaging the buttstock from the grip and folding or otherwise positioning the buttstock over the scope such that at least a portion of the scope is covered by and positioned inside the buttstock, thereby placing the buttstock in the stowed configuration. To use the rifle, the buttstock may be deployed (e.g., unfolded) away from the scope and placed in the deployed configuration.

DETAILED DESCRIPTION

Figure 1:
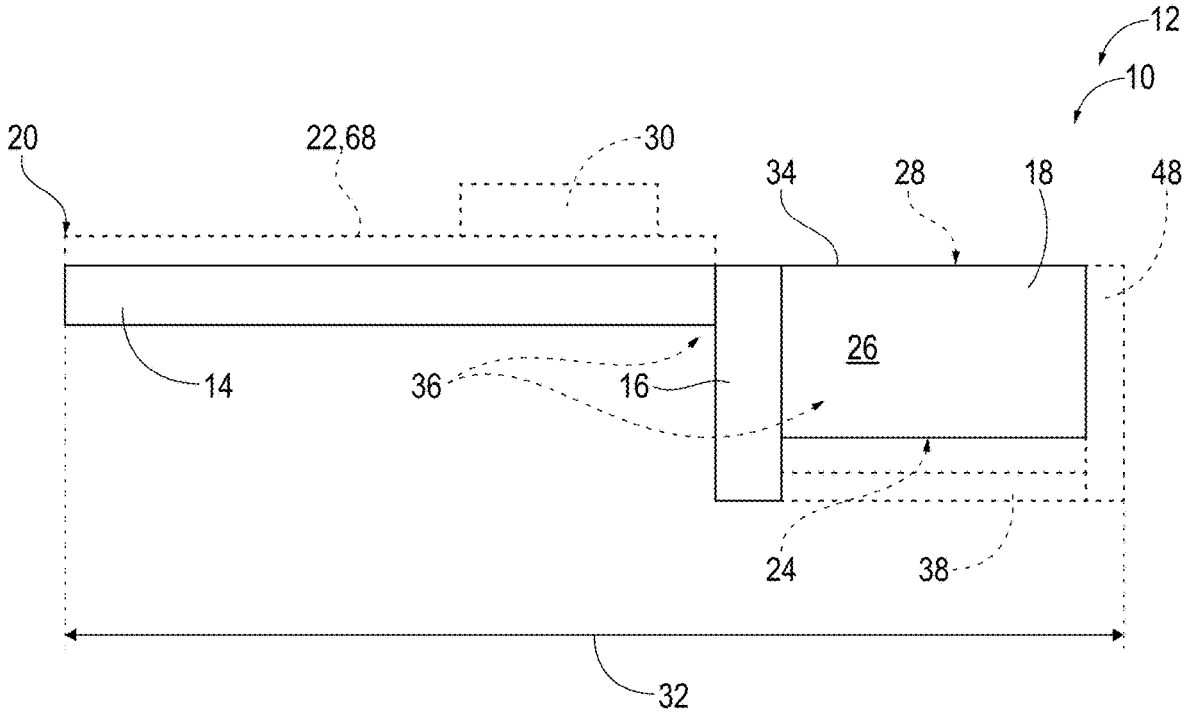
FIG. 1 is a schematic, black box representation of non-exclusive examples of a stock according to the present disclosure, shown in a deployed configuration.
Figure 2:
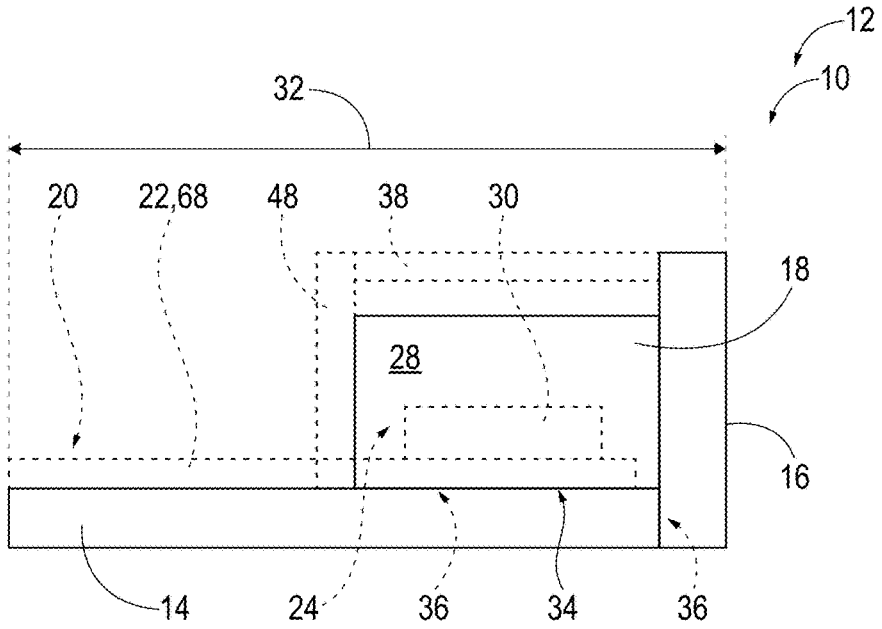
FIG. 2 is a schematic, black box representation of non-exclusive examples of a stock according to the present disclosure, shown in a stowed configuration.

FIGS. 1-2 provide illustrative, non-exclusive examples of stocks 10 and systems 12 including the same according to the present disclosure. Elements that serve a similar, or at least substantially similar, purpose are labeled with like numbers in each of FIGS. 1-2, and these elements may not be discussed in detail herein with reference to each of FIGS. 1-2. Similarly, all elements may not be labeled in each of FIGS. 1-2, but reference numerals associated therewith may be utilized herein for consistency. Elements, components, and/or features that are discussed herein with reference to one or more of FIGS. 1-2 may be included in and/or utilized with any of FIGS. 1-2 without departing from the scope of the present disclosure. In general, elements that are likely to be included in a given (i.e., a particular) example are illustrated in solid lines, while elements that are optional to a given example are illustrated in dashed lines. However, elements that are shown in solid lines are not essential to all examples, and an element shown in solid lines may be omitted from a particular example without departing from the scope of the present disclosure.

FIG. 1 shows stock 10 in a deployed configuration, while FIG. 2 shows stock 10 in a stowed, or folded, configuration. Stocks 10 are generally described and illustrated herein as used with a rifle, though it is within the scope of the present disclosure that stocks 10 may be used with other long guns or firearms, as will be understood by those of ordinary skill in the art. Stock 10 includes a forestock 14, a hand grip 16 (referred to herein as simply grip 16), and a buttstock 18. Forestock 14 is configured to engage with an action 22 and/or a barrel 68 of a firearm 20 (e.g., a rifle, a shot gun, or other firearm 20), and grip 16 is pivotally coupled to forestock 14. To transition stock 10 to the stowed configuration, grip 16 and buttstock 18 are pivoted with respect to forestock 14. Thus, forestock 14 serves as a pivot point for folding stock 10 to the stowed configuration. Stock 10 may be configured such that transitioning between the deployed configuration and the stowed configuration is quick and easy. Stock 10 may have a thin profile when in the stowed configuration.

Buttstock 18 may be a shell that defines an internal volume 24 between a first sidewall 26 and a second sidewall 28 of buttstock 18. Stock 10 is configured to be selectively transitioned between the deployed configuration of FIG. 1 and the stowed configuration of FIG. 2. In the deployed configuration (FIG. 1), buttstock 18 is engaged with grip 16. In the stowed configuration (FIG. 2), buttstock 18 is disengaged from grip 16. For example, in the stowed configuration, buttstock 18 may be positioned such that it does not directly contact grip 16, though buttstock 18 may be indirectly coupled to grip 16 via other components of stock 10 in some examples. In other examples, buttstock 18 may contact grip 16 in the stowed configuration while still being disengaged therefrom. In the stowed configuration, buttstock 18 is engaged with forestock 14 and positioned such that internal volume 24 opens towards forestock 14. In this manner, buttstock 18 is configured to at least partially surround a scope 30 of firearm 20 in the stowed configuration, as represented in FIG. 2. In some examples, buttstock 18 of stock 10 is configured to cover the entire scope 30 of firearm 20 when stock 10 is in the stowed configuration. In other examples, buttstock 18 covers a portion of scope 30, while a portion of scope 30 may be exposed.

Thus, stock 10 may be configured to protect scope 30 of firearm 20 from impacts when stock 10 is in the stowed configuration. To withstand impacts, stock 10 may be formed from a rigid or semi-rigid material. For example, at least a portion of stock 10 may be formed from fiber reinforced nylon or other rigid and impact-resistant injection molded plastic, carbon fiber reinforced composites, other composite materials such as fiberglass reinforced composites, formed or welded sheet metal, laminated wood, machined aluminum, machined magnesium, formed steel, fiber reinforced plastic with low-friction internal inserts or overmolds (injection molded or pultrusion), telescopic composite extrusions, metal extrusions such as aluminum or titanium, and/or machined or stamped metal (e.g., aluminum, titanium, and/or steel). Grip 16 may include a plastic or rubber over the grip. A butt plate 48 may include a rubber or polymer foam pad attached thereto. In various examples of stock 10, forestock 14 and buttstock 18 may be formed using the same material(s), while in other examples, forestock 14 and buttstock 18 may be formed of different material(s). Similarly, grip 16 may be formed of one or more material(s) used in forestock 14 and/or buttstock 18, or grip 16 may be formed using one or more different material(s). In some specific examples, buttstock 18 may be formed from fiber reinforced nylon or other rigid and impact-resistant injection molded plastic, carbon fiber, other composite materials such as fiberglass could work, and/or formed or welded sheet metal, forestock 14 may be formed be fiber reinforced nylon or other rigid and impact-resistant injection molded plastic, carbon fiber and other composites, laminated wood, and/or machined aluminum or magnesium, grip 16 may be formed from fiber reinforced nylon or other rigid and impact-resistant injection molded plastic, machined aluminum, and/or formed steel with a plastic or rubber over grip, an elongate arm 38 of stock 10 may be formed from fiber-reinforced plastic with low friction internal inserts or overmolds (injection molded or pultrusion), telescopic composite extrusions, and/or metal extrusions such as aluminum or titanium, butt plate 48 may be formed from machined or stamped metal (e.g., aluminum, titanium, and/or steel) with rubber or polymer foam pad attached, and/or a fiber reinforced plastic, and various components of a latching mechanism 36 may be formed from machined metals such as aluminum, titanium, and/or steel, or other suitable materials.

In some examples, buttstock 18 is sized and shaped relative to scope 30 such that first sidewall 26 and second sidewall 28 do not contact scope 30 when stock 10 is in the stowed configuration. For example, sidewalls 26, 28 may be positioned on either side of scope 30 in the stowed configuration without directly contacting scope 30, so as to avoid causing scope 30 to be misaligned or uncalibrated. Additionally or alternatively, buttstock 18 may include a top wall 34 that extends between sidewalls 26, 28, and stock 10 may be configured such that top wall 34 does not contact scope 30 when stock 10 is in the stowed configuration. For example, buttstock 18 may be sized to be tall enough relative to scope 30 such that a space is maintained within internal volume 24 of buttstock 18, between the top of scope 30 and top wall 34 of buttstock 18, when stock 10 is in the stowed configuration. Because of the protection afforded to scope 30 via disclosed stocks 10 in the stowed configuration, firearm 20 and attached stock 10 may be configured to be stowed in a backpack or a sling when stock 10 is in the stowed configuration to provide protection to scope 30 from impacts, scratches, wear on the lenses, and/or inadvertent scope turret setting adjustments during carrying and/or transport.

To this end, systems 12 may further include a backpack and/or a sling configured to store and transport stock 10 and firearm 20 when stock 10 is in the stowed configuration. Disclosed stocks 10 also may be configured to protect scope 30 from items resting against or on scope 30 while in a pack, inside a vehicle, and/or in a sling. In some examples, disclosed stocks 10 are configured to protect scope 30 as if firearm 20 was stored inside a hard gun case, while providing the portability of a folded stock firearm. The folded (e.g., shortened) nature of stock 10 in the stowed configuration can advantageously enable a user to sit down without removing stock 10 (and attached firearm 20) from the sling, which is typically not feasible with conventional stocks. In some examples, stocks 10 may include one or more sling quick connect points 174, which can be seen in, for example, FIG. 5 on forestock 14, grip 16, and elongate arm 38 near butt plate 48. To enable the sling to still be useful when stock 10 is in the stowed configuration, the end point of the sling that is normally attached right below butt plate 48 may be detached and reconnected at the end of the grip 16. Quick connect firearm slings are known in the art, and only takes seconds to move, which would then allow the folded firearm to lay flat against the user's back when on the sling.

As visible from FIGS. 1 and 2, an overall length 32 of stock 10 is reduced in the stowed configuration (FIG. 2) as compared to the overall length 32 in the deployed configuration (FIG. 1). As will be described in detail herein, stock 10 may include one or more latching mechanisms 36. Latching mechanism 36 may be configured to secure stock 10 in the deployed configuration, as well as secure stock 10 in the stowed configuration. For example, latching mechanism 36 may be configured to secure buttstock 18 to grip 16 in the deployed configuration relative to forestock 14 to prevent rotation of grip 16 relative to forestock 14. Latching mechanism 36 also may be configured to secure buttstock 18 to (or relative to) forestock 14 in the stowed configuration to constrain movement of buttstock 18 relative to forestock 14 along a longitudinal axis of forestock 14 (e.g., along length 32). Additionally or alternatively, latching mechanism 36 may be configured to constrain movement of buttstock 18 relative to forestock 14 in a vertical direction (e.g., perpendicular to the longitudinal axis of forestock 14) when stock 10 is in the stowed configuration. Latching mechanism 36 may include a plurality of mechanisms or components of stock 10 that may be configured to perform such functions. Latching mechanism 36 may be configured to resist a recoil of firearm 20 when in use, such that latching mechanism 36 remains secure when firearm 20 is fired, and yet still be quick and easy to latch and unlatch (e.g., engage and disengage). In some examples, forestock 14 serves as a latching point for latching mechanism 36 when stock 10 is in the stowed configuration. Additionally or alternatively, some or all components of latching mechanism 36 may be at least partially hidden and/or protected (e.g., by being positioned at least partially within internal volume 24 of buttstock 18).

In some examples of stock 10, grip 16 and buttstock 18 pivot behind action 22, with grip 16 being coupled to a butt plate 48 by an elongate arm 38 at a base of grip 16. Buttstock 18 may be pivotally connected to butt plate 48, and stock 10 may be folded over scope 30 when a user actuates latching mechanism 36 to move stock 10 to the stowed configuration.

In some examples, forestock 14 and buttstock 18 may be selectively separable from each other, and buttstock 18 may be removed and placed over scope 30 and coupled to forestock 14 without folding or pivoting stock 10. Stock 10 may be configured such that linear motion of buttstock 18 (e.g., motion along length 32 of stock 10) relative to forestock 14 in a first direction serves to secure buttstock 18 to forestock 14, while linear motion of buttstock 18 relative to forestock 14 in a second direction along length 32 serves to disengage buttstock 18 from forestock 14. Additionally or alternatively, stock 10 may be configured such that twisting or rotational movement of buttstock 18 about the longitudinal axis of barrel 68 serves to engage or disengage buttstock 18 with respect to forestock 14.

In some examples, stock 10 may be configured such that buttstock 18 folds to a side of firearm 20, and then hinges up-and-over scope 30 from the side of firearm 20. In some examples, a portion of buttstock 18 may fold away to expose an open cavity (e.g., internal volume 24), and then buttstock 18 may be folded over scope 30 without needing to pivot or rotate to expose internal volume 24. Additionally or alternatively, buttstock 18 may be telescoping, expandable, or extendable to cover longer scopes 30.

Disclosed stocks 10 may be configured to be modular and adaptable to a plurality of different types of rifles or other firearms. For example, the length and shape of forestock 14 may be designed to accommodate or receive different lengths or sizes of rifle barrels. Size and shape of buttstock 18 may be adjusted to accommodate different sizes or shapes of scopes 30, and grips 16 may be sized and styled to work with different types of firearms as well. Generally, buttstock 18 is not designed for any one scope in particular, but may be individually designed in some examples. In some examples, at least some parts and components of stock 10 may be universal such that they may work with any rifle, long gun, or other firearm, while forestock 14 may be customized or modified to fit an individual rifle or other firearm. To attach disclosed stocks 10 to a rifle or other firearm, forestock 14 may be bolted to an action of firearm 20, such as is described in further detail in connection with FIGS. 17-18.

Turning now to FIGS. 3-30, illustrative non-exclusive examples of stocks 10 and/or systems 12 are illustrated. Where appropriate, the reference numerals from the schematic illustrations of FIGS. 1-2 are used to designate corresponding parts of FIGS. 3-30; however, the examples of FIGS. 3-30 are non-exclusive and do not limit stocks 10 or systems 12 to the illustrated examples of FIGS. 3-30. That is, stocks 10 and systems 12 are not limited to the specific examples of the illustrated FIGS. 3-30, and may incorporate any number of the various aspects, configurations, characteristics, properties, etc. of stocks 10 or systems 12 that are illustrated in and discussed with reference to the schematic representations of FIGS. 1-2 and/or the examples of FIGS. 3-30, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again in FIGS. 3-30; however, it is within the scope of the present disclosure that the previously discussed features, variants, etc. may be utilized therewith.

Figure 3:
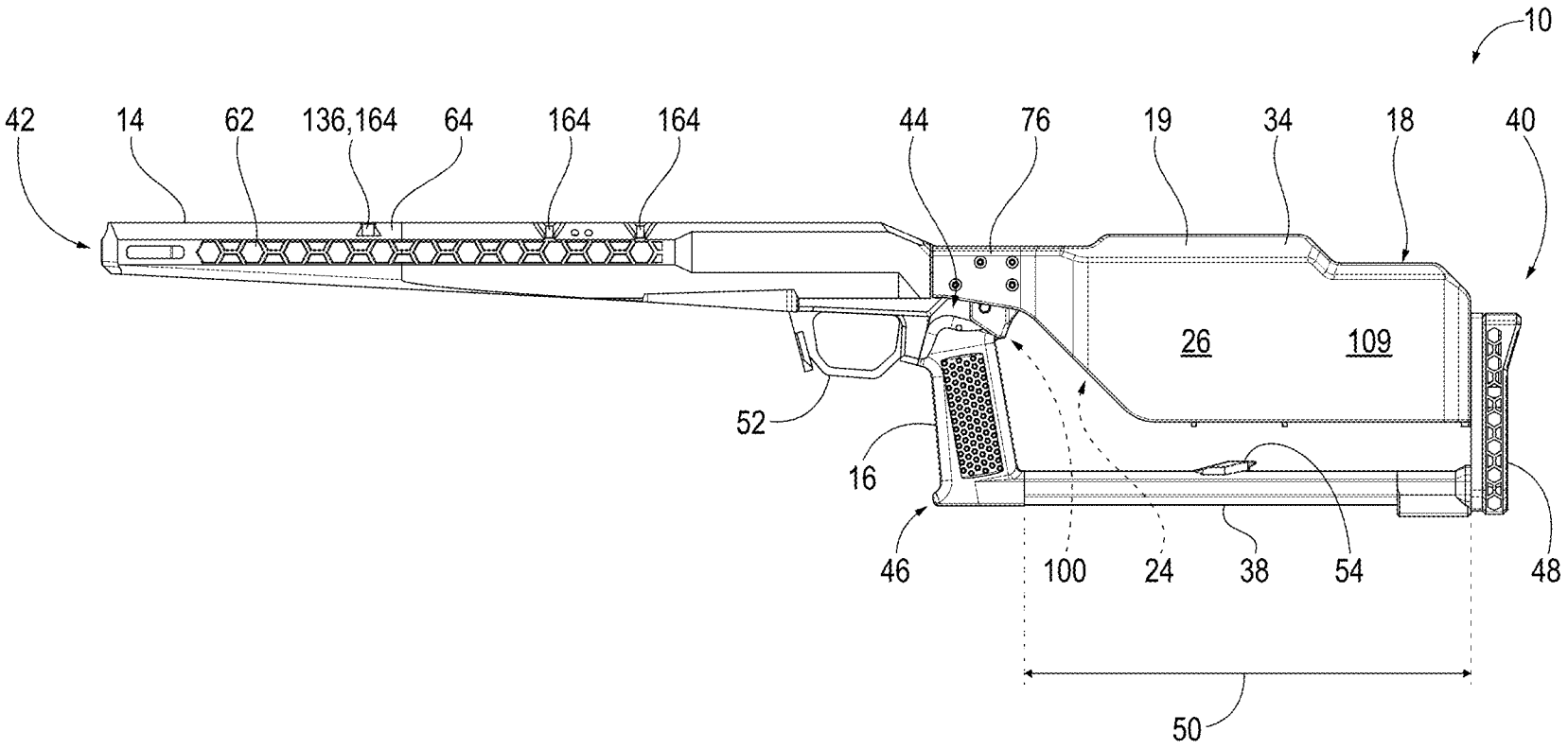
FIG. 3 is a side elevation view of an example of a stock according to the present disclosure.
Figure 4:
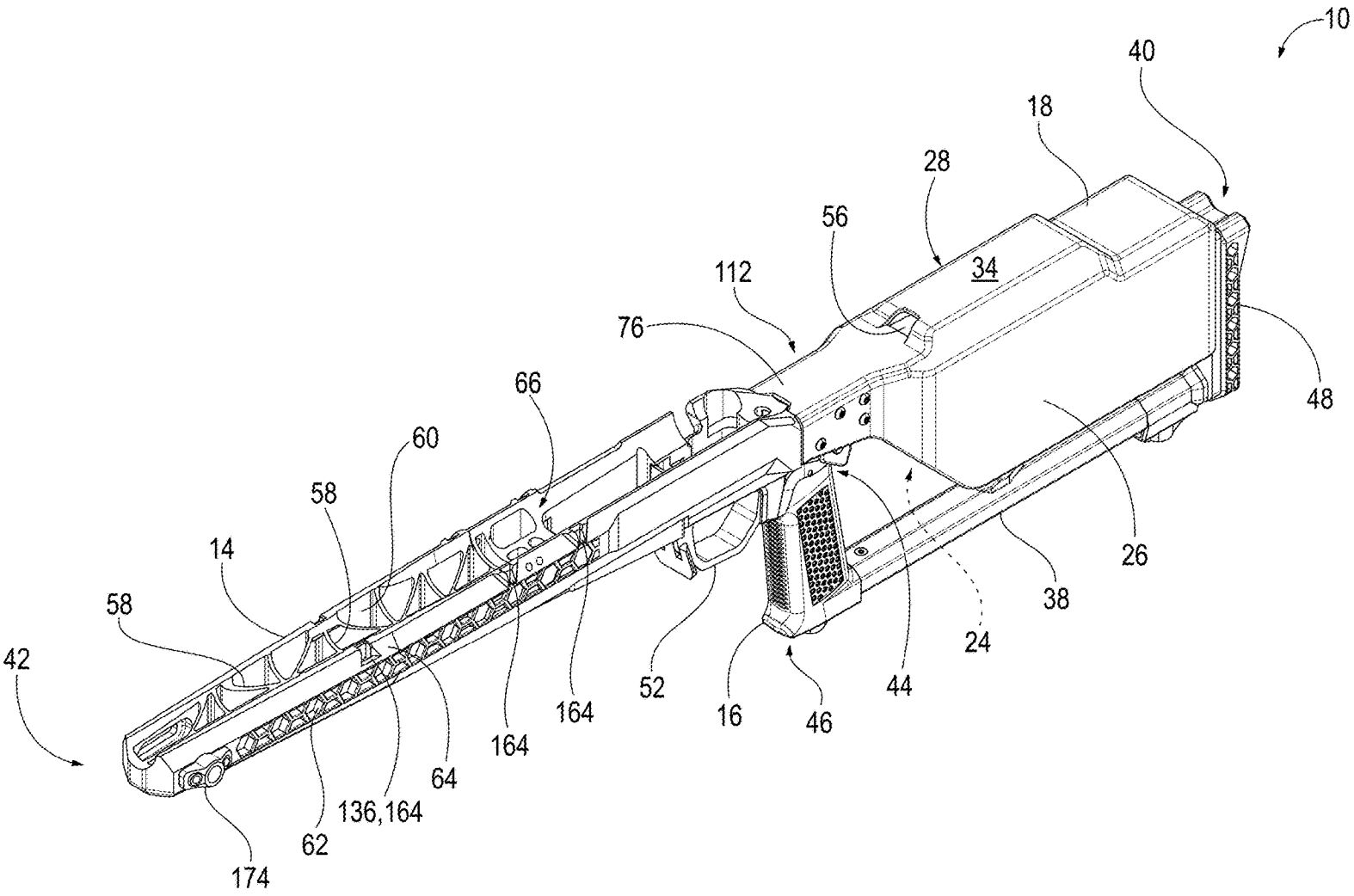
FIG. 4 is a perspective view of an example of a stock according to the present disclosure.

FIGS. 3 and 4 show a side elevation view and a perspective view, respectively, of an example of stock 10 according to the present disclosure. In FIGS. 3-4, stock 10 is shown without a firearm for clarity, and is illustrated in the deployed configuration. In the deployed configuration, forestock 14 extends distally (e.g., towards a distal end 42 of stock 10) from grip 16, while buttstock 18 extends proximally (e.g., towards a proximal end 40) from grip 16. Buttstock 18 is shown engaged with grip 16 in the deployed configuration. In the deployed configuration, movement (e.g., rotation and/or linear movement) of grip 16 and buttstock 18 are at least substantially locked with respect to forestock 14. Buttstock 18 may include a cheek rest or cheek piece 19 configured for a user to rest a cheek against while using firearm 20 (e.g., when stock 10 is in the deployed configuration).

Stock 10 may include an elongate arm 38 extending from grip 16. In the deployed configuration, elongate arm 38 extends proximally from grip 16 towards and/or to proximal end 40 of stock 10. Grip 16 may be said to extend from a first end region 44 to a second end region 46 opposite first end region 44 with buttstock 18 engaged with (e.g., in contact with and/or directly coupled to) first end region 44 in the deployed configuration, and with elongate arm 38 extending proximally from second end region 46. In the deployed configuration, internal volume 24 of buttstock 18 may face elongate arm 38, as shown in FIGS. 3-4. In some examples, elongate arm 38 is telescoping, such that a length 50 of elongate arm 38 is selectively adjustable. In some examples, length 50 of elongate arm 38 is fixed when buttstock 18 is engaged with grip 16 in the deployed configuration, and length 50 of elongate arm 38 is selectively adjustable when buttstock 18 is disengaged from grip 16. In other words, engagement of buttstock 18 with grip 16 may be configured to prevent elongation of elongate arm 38, due to elongate arm 38 and buttstock 18 each being coupled to grip 16 and butt plate 48. Additionally or alternatively, elongate arm 38 may include a fin, or other projection, 54 extending from or projecting from elongate arm 38 (best seen in FIG. 3). Buttstock may include a complementary recess 56 (best seen in FIG. 4) configured to receive fin 54 as stock 10 is moved towards the stowed configuration (e.g., once buttstock 18 is rotated with respect to elongate arm 38, such that top wall 34 of buttstock 18 faces and is adjacent to elongate arm 38, as will be described in further detail herein).

Stock 10 may include butt plate 48. When using, for example, a rifle coupled to stock 10, butt plate 48 may be configured to rest against the user's shoulder. Buttstock 18 is coupled to butt plate 48 such that buttstock 18 may be selectively pivoted with respect to butt plate 48 when buttstock 18 is disengaged from grip 16. However in the deployed configuration, buttstock 18 may be at least substantially fixed with respect to butt plate 48. Elongate arm 38 may extend from grip 16 to butt plate 48, as shown in FIGS. 3-4. Stock 10 additionally or alternatively may include a trigger guard 52 engaged with (e.g., coupled to) grip 16 and forestock 14. Said trigger guard 52 is configured to prevent unintentional contact with a trigger of a firearm while engaged with stock 10.

In some examples, forestock 14 includes trussing 58 on an inner surface 60 of forestock 14 (e.g., within an opening 66 for receiving a portion of a rifle or other firearm). Said trussing 58 may be configured for imparting rigidity and/or for weight-reduction of forestock 14. Additionally or alternatively, forestock 14 may include a honeycomb pattern 62 on an outer surface 64 of forestock 14. Said honeycomb pattern 62 may be configured for weight-reduction of forestock 14 and/or simply for aesthetic effect. In various examples of disclosed stocks 10, honeycomb pattern 62 may extend to as greater or lesser extent along the length and/or width of forestock 14. The examples of trussing 58 and patterns 62 are not meant to be limiting, and other patterns and features that serve similar functions also are within the scope of the present disclosure, and may be included in forestocks 14 of disclosed stocks 10, in addition to or instead of the illustrated trussing 58 and patterns 62.

Figure 5:
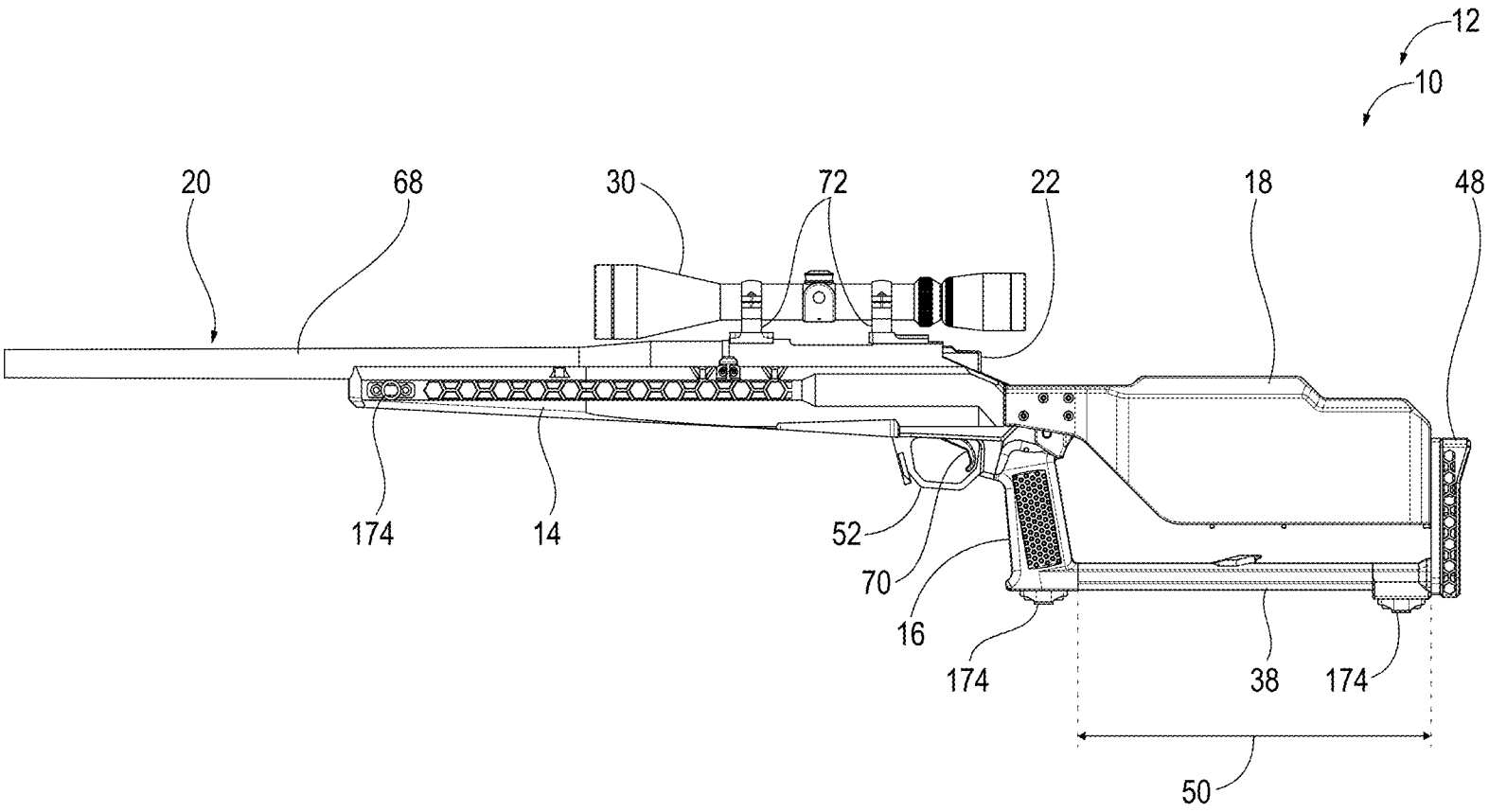
FIG. 5 is a side elevation view of an example of a system according to the present disclosure with a stock operatively coupled to a firearm, shown in the deployed configuration.

FIG. 5 illustrates an example of system 12, showing an example of stock 10 engaged with (e.g., operatively coupled to) rifle 20 (which is an example of firearm 20). When stock 10 is coupled to rifle 20, at least a portion of a barrel 68 is positioned within opening 66 of forestock 14, and action 22 may be bolted or otherwise fastened to stock 10. A trigger 70 of rifle 20 is encircled by trigger guard 52 of stock 10. Scope 30 is coupled to barrel 68 and/or to action 22 by one or more conventional attachment points 72.

Figure 6:
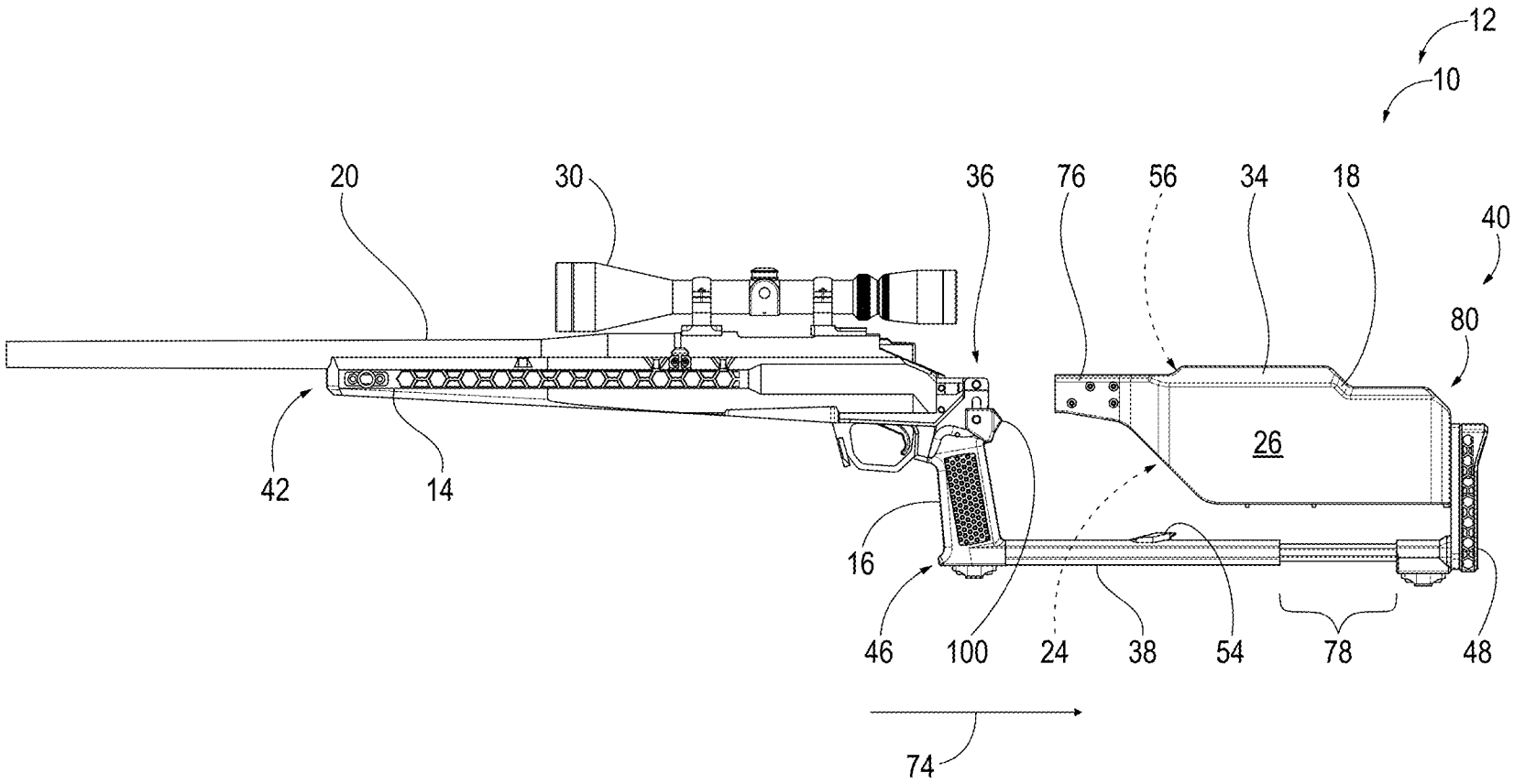
FIG. 6 is a side elevation view of the system of FIG. 5, shown with a buttstock disengaged from a grip.
Figure 11:
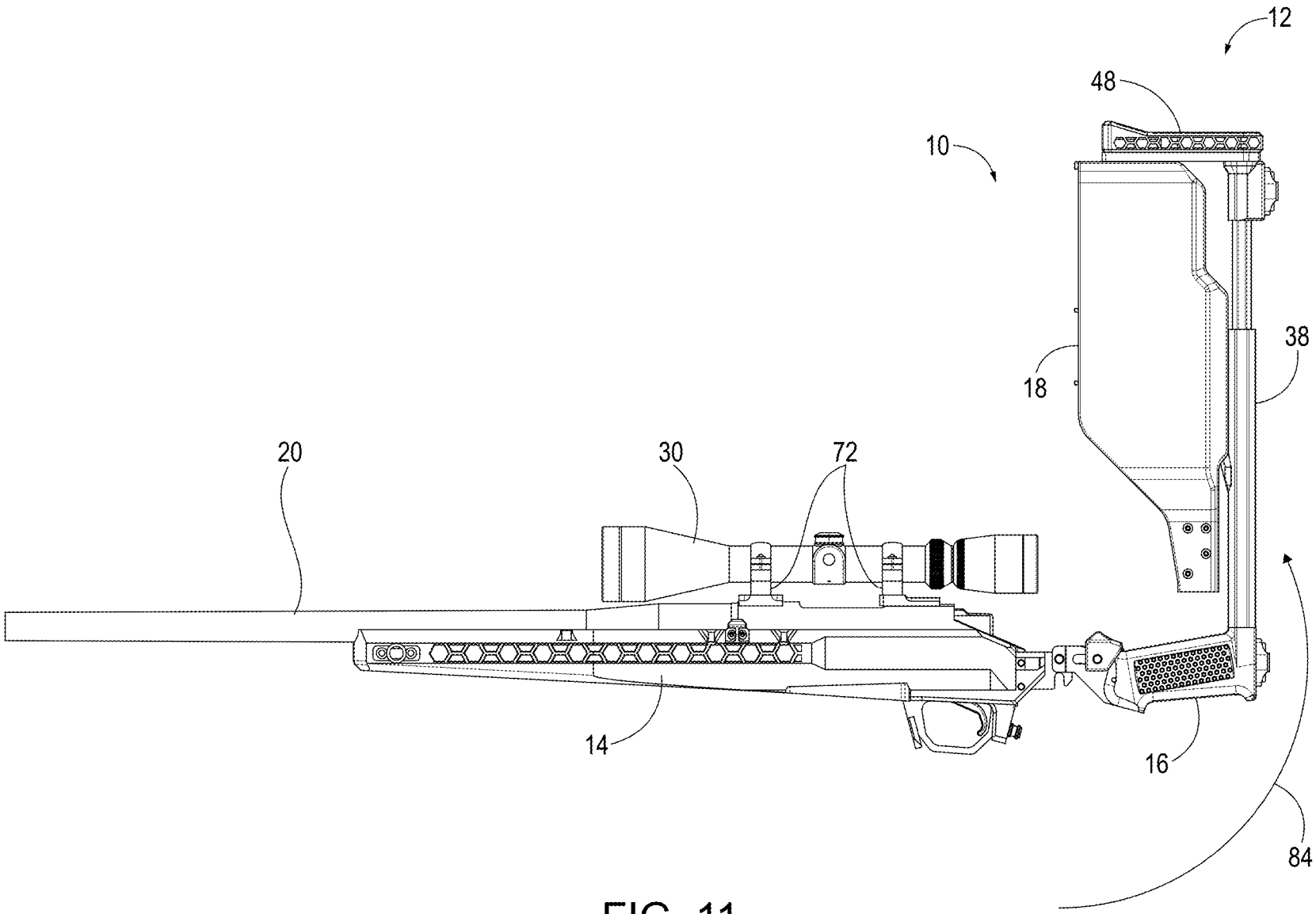
FIG. 11 is a side elevation view of the system of FIGS. 5-10 with the grip and the buttstock further folded with respect to the forestock.
Figure 12:
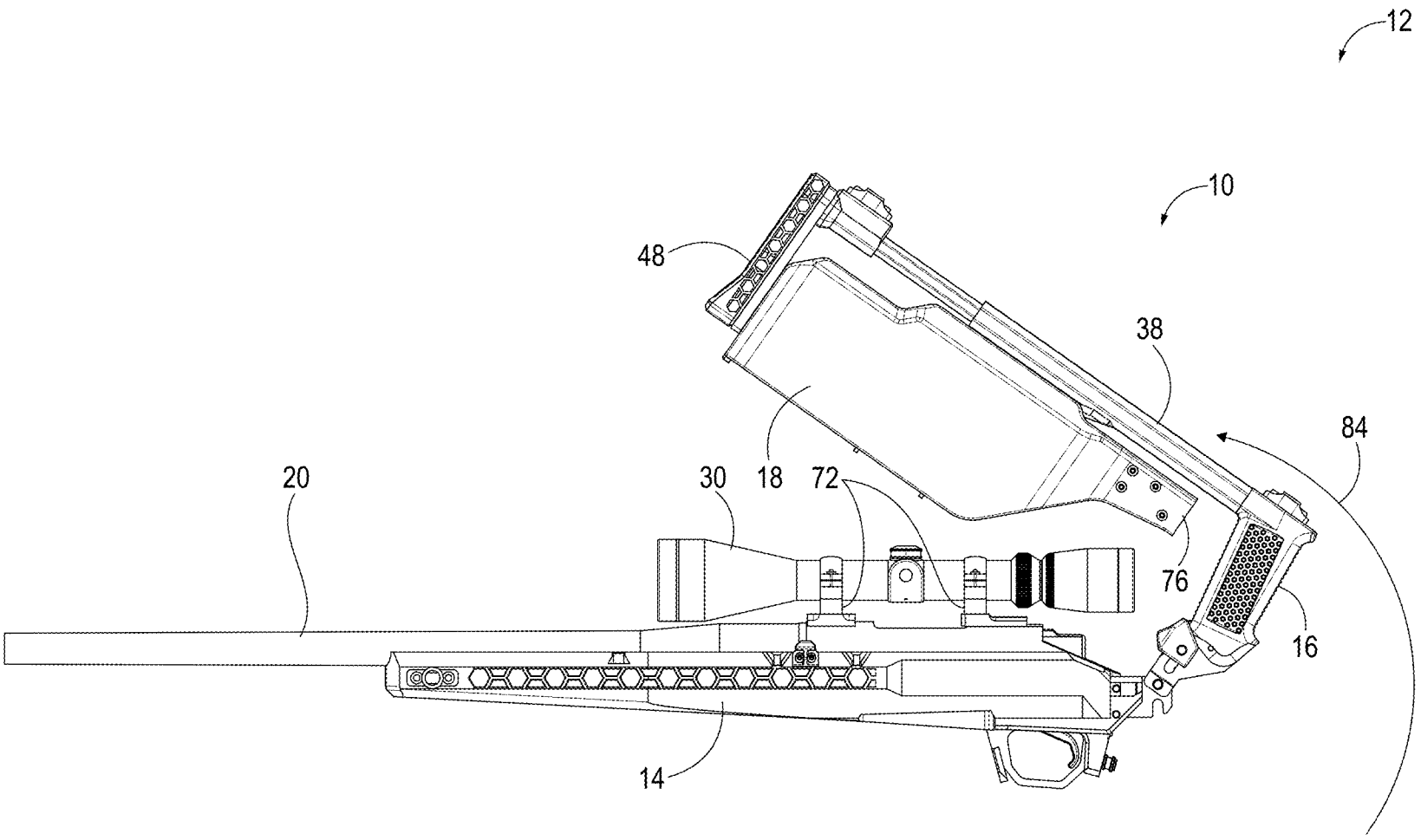
FIG. 12 is a side elevation view of the system of FIGS. 5-11 with the grip and the buttstock even further folded with respect to the forestock and almost in the stowed configuration.
Figure 13:
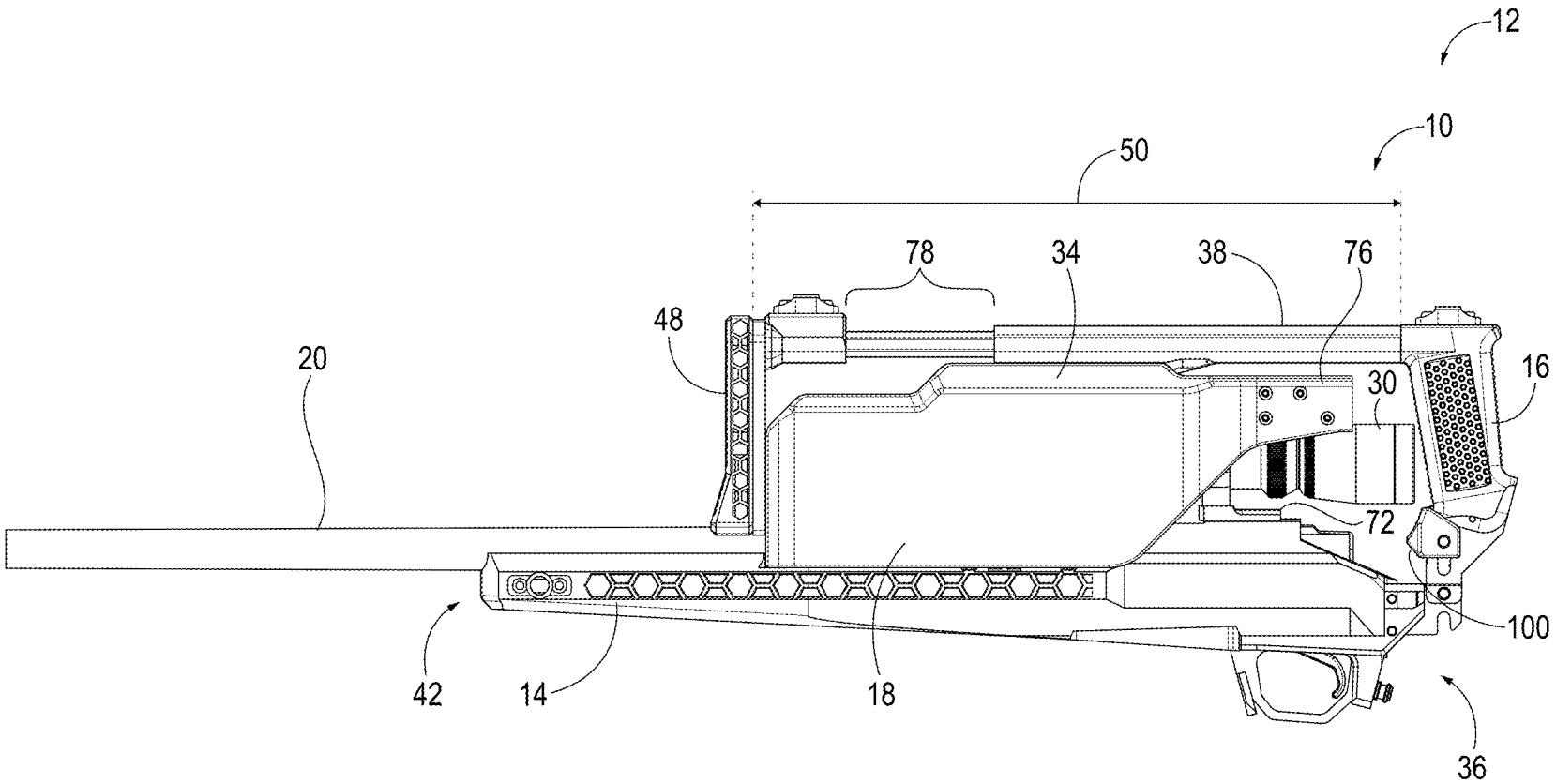
FIG. 13 is a side elevation view of the system of FIGS. 5-12 with the buttstock in the stowed configuration.

FIGS. 6-13 illustrate stock 10 transitioning from the deployed configuration, shown in FIG. 5, to the stowed configuration, shown in FIG. 13. First, as shown in FIG. 6, buttstock 18 is disengaged from grip 16, then buttstock 18 can be translated away from grip 16 and forestock 14 by moving buttstock 18 in the direction indicated by arrow 74 (e.g., proximally or away from distal end 42). Specifically, a wrist 76 of buttstock 18 is released from, or disengaged from, grip 16 to allow translation of buttstock 18 away from forestock 14 along arrow 74 (e.g., along the longitudinal axis of stock 10), thereby creating a space or gap between wrist 76 and grip 16/forestock 14. Elongate arm 38 extends in length (e.g., by telescoping) as indicated at 78, to accommodate the translation of buttstock 18 away from forestock 14 and grip 16 in the direction of arrow 74. When wrist 76 is disengaged from grip 16, buttstock 18 is still operatively (though indirectly) coupled to grip 16 (e.g., region 46 of grip 16) via elongate arm 38 and butt plate 48, because butt plate 48 is coupled to both a shoulder end region 80 of buttstock 18 and to elongate arm 38. Thus, when elongate arm 38 is extended to translate buttstock 18 away from grip 16 and forestock 14, butt plate 48 also is translated away from grip 16 and forestock 14. Shoulder end region 80 of buttstock 18 is generally opposite wrist 76 of buttstock 18.

Figure 7:
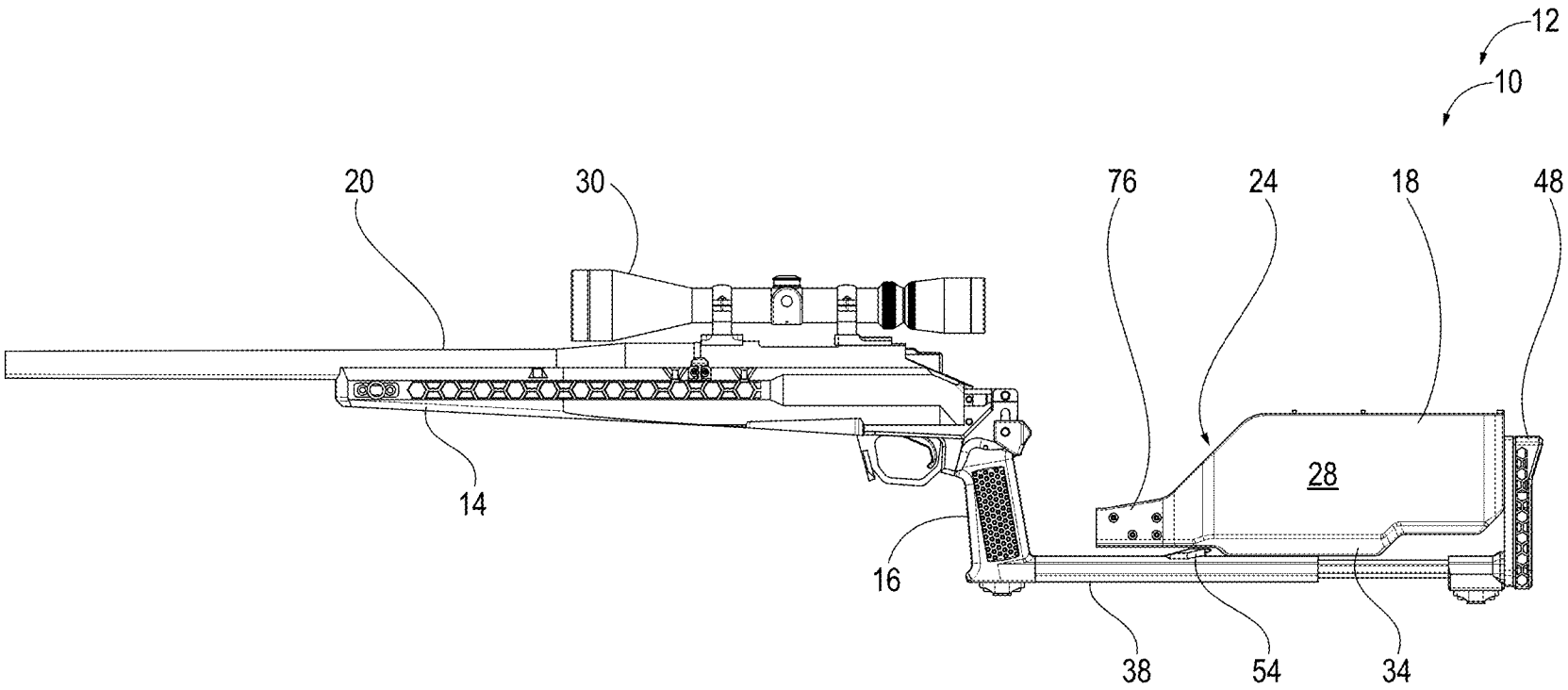
FIG. 7 is a side elevation view of the system of FIGS. 5-6 shown with the buttstock pivoted 180 degrees with respect to the grip and a forestock.

Next, with reference to FIG. 7, buttstock 18 is shown having been pivoted with respect to forestock 14, grip 16, elongate arm 38, and butt plate 48. Specifically, buttstock 18 may be flipped, rotated, or pivoted by about 180 degrees, or possibly even exceeding 180 degrees in some examples, with respect to forestock 14, grip 16, elongate arm 38, and butt plate 48. For example, buttstock 18 is in a first orientation in FIG. 6 and has been pivoted to a second orientation in FIG. 7. Buttstock 18 is pivoted 180 degrees between the orientations shown in FIGS. 6 and 7. In the first orientation of FIG. 6, internal volume 24 of buttstock 18 faces elongate arm 38, whereas in the second orientation of FIG. 7, internal volume 24 faces away from elongate arm 38. Similarly, top wall 34 of buttstock 18 faces away from elongate arm 38 in the first orientation of FIG. 6, and top wall 34 faces towards (and is adjacent to) elongate arm 38 in the second orientation of FIG. 7. The pivoting of buttstock 18 is also apparent from the sidewalls 26, 28 of buttstock 18. Specifically, first sidewall 26 faces out of the page in the first orientation in FIG. 6, while in the second orientation in FIG. 7, buttstock 18 is rotated such that second sidewall 28 faces out of the page. Buttstock 18 may be pivotally coupled to butt plate 48 to allow such rotation of buttstock 18 relative to the other components of stock 10.

Figure 8:
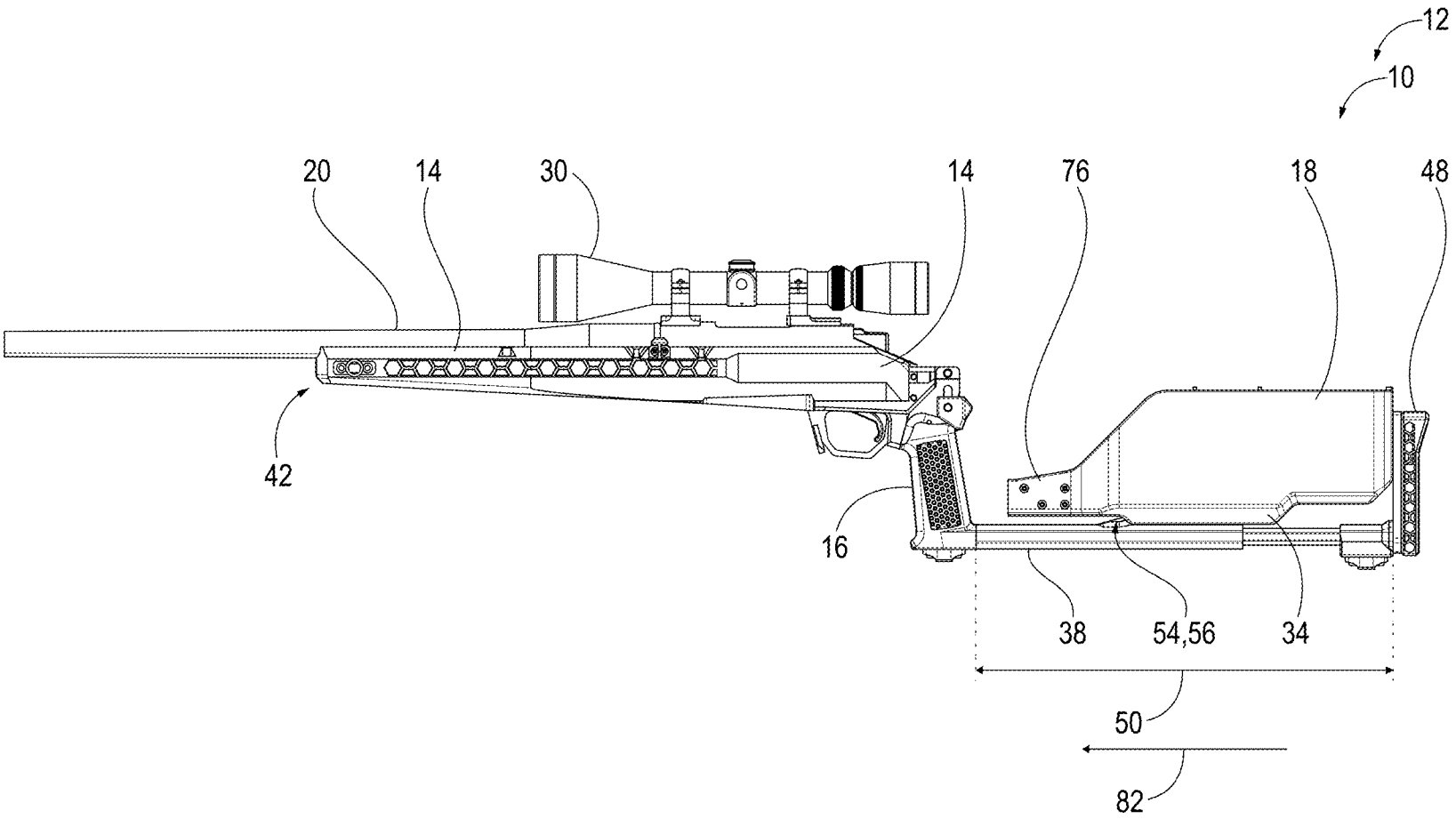
FIG. 8 is a side elevation view of the system of FIGS. 5-7, shown with the buttstock translated forward towards the forestock such that the buttstock is locked in place with respect to the grip.
Figure 9:
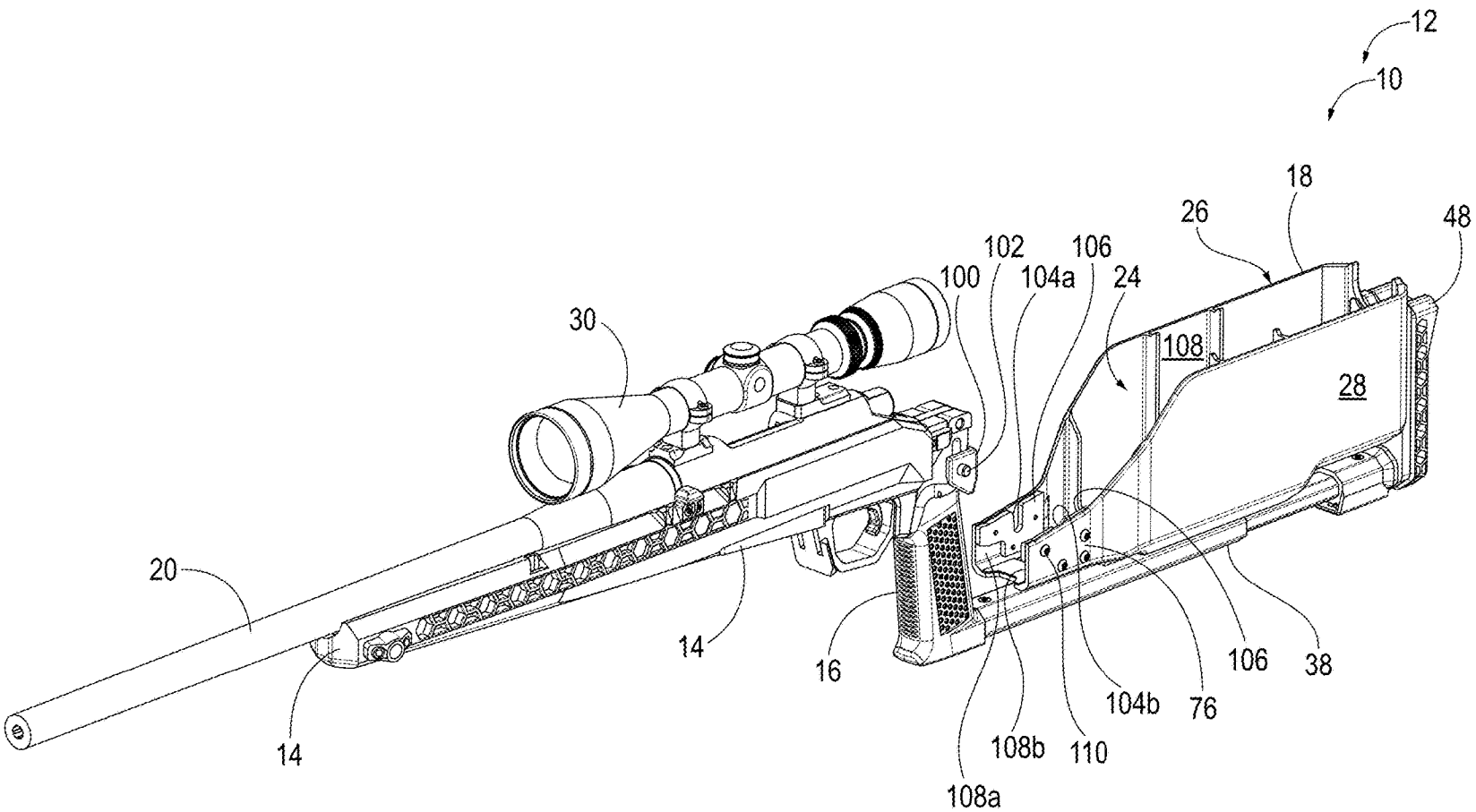
FIG. 9 is a perspective view of the system of FIGS. 5-8 shown in the same position as in FIG. 8, viewed from a different angle.

Next, with reference to FIG. 8, while buttstock 18 is in the second (e.g., pivoted or upside down) orientation, buttstock 18 may be translated back towards grip 16 and forestock 14 until fin 54 on elongate arm 38 is at least partially inserted into, nested into, or engaged with recess 56 formed in top wall 34 of buttstock 18. To accomplish this engagement between fin 54 and recess 56, buttstock 18 is translated in a direction indicated by arrow 82 (e.g., along the longitudinal axis of stock 10 and towards distal end 42 of stock 10) while buttstock 18 is in the second orientation described above. When fin 54 on elongate arm 38 is engaged with recess 56 of buttstock 18, such engagement at least substantially prevents further movement (e.g., translation) of buttstock 18 towards grip 16. While stock 10 is illustrated in FIG. 8 with fin 54 and recess 56 for this engagement, other mechanisms also are within the scope of the present disclosure, such as a magnetic interaction between elongate arm 38 and buttstock 18 to hold it in the correct position for folding, and/or a limiting mechanism and/or detent internal to elongate arm 38 that holds it in place for folding. Any such mechanism may be suitable that is configured to at least substantially lock the longitudinal position of buttstock 18 with respect to elongate arm 38. For example, fin 54 and recess 56 may be sized and shaped complementarily to each other such that once fin 54 is inserted in and engaged with recess 56, the length 50 of elongate arm 38 remains substantially constant until the fin 54 is selectively removed from recess 56 to once again allow telescoping movement of elongate arm 38 and thereby translation of buttstock 18 with respect to forestock 14 and grip 16. FIG. 9 shows another view of the position shown in FIG. 8.

Figure 10:
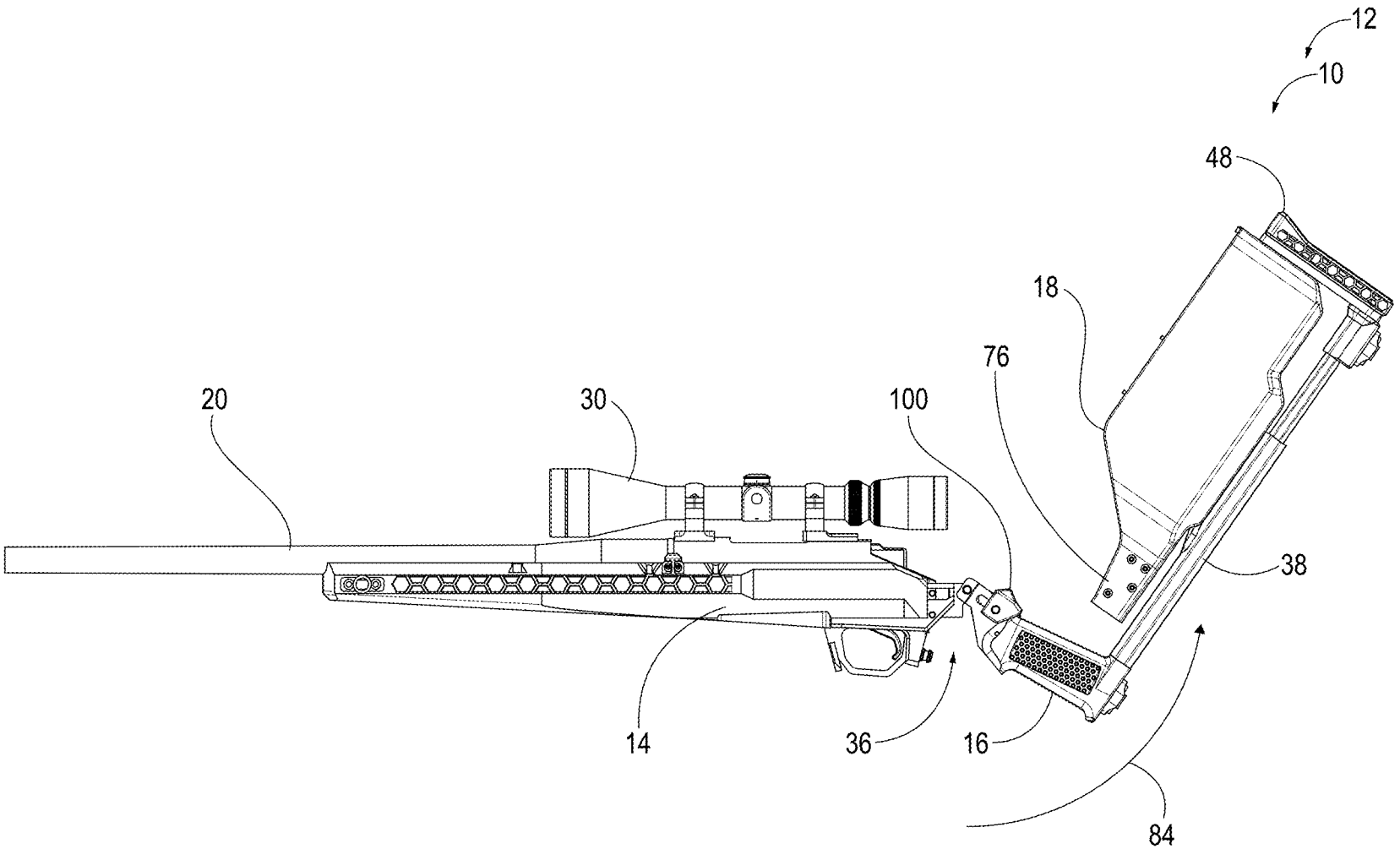
FIG. 10 is a side elevation view of the system of FIGS. 5-9 with the grip and the buttstock beginning to be folded with respect to the forestock.

Next, with reference to FIGS. 10-13, grip 16 and buttstock 18 (and elongate arm 38 and butt plate 48) may be pivoted with respect to forestock 14 to position buttstock 18 at least partially over scope 30, such that buttstock 18 is in the stowed configuration in FIG. 13 and configured to protect scope 30 from impacts. As shown in FIGS. 10-13, in some examples, grip 16 pivots with respect to forestock 14, thereby also pivoting elongate arm 38, buttstock 18, and butt plate 48 with respect to forestock 14 by generally moving grip 16, elongate arm 38, buttstock 18, and butt plate 48 in the direction indicated by arrow 84, until buttstock 18 is folded onto forestock 14 to at least partially cover scope 30, as shown in the stowed configuration of FIG. 13. As grip 16 is pivoted, the elongate arm 38, buttstock 18, and butt plate 48 move with grip 16, due to elongate arm 38 being coupled to grip 16 and due to the position of buttstock 18 being locked with respect to elongate arm 38 (e.g., due to engagement between fin 54 of elongate arm 38 and recess 56 of buttstock 18). FIGS. 10-13 show buttstock 18 at various points in the pivoting movement, with FIG. 10 showing grip 16 having been pivoted around 45 degrees from its starting position of the deployed configuration, FIG. 11 showing grip 16 having been pivoted around 90 degrees from its starting position, FIG. 12 showing grip 16 having been pivoted around 135 degrees from its starting position, and FIG. 13 showing grip 16 having been pivoted around 180 degrees from its starting position to arrive at the stowed configuration. Thus, grip 16 may be configured to pivot at least 180 degrees, or substantially or approximately 180 degrees, with respect to forestock 14 between the deployed configuration and the stowed configuration of stock 10. The steps illustrated in FIGS. 6-13 may generally be reversed to selectively transition stock 10 back to the deployed configuration.

Figure 14:
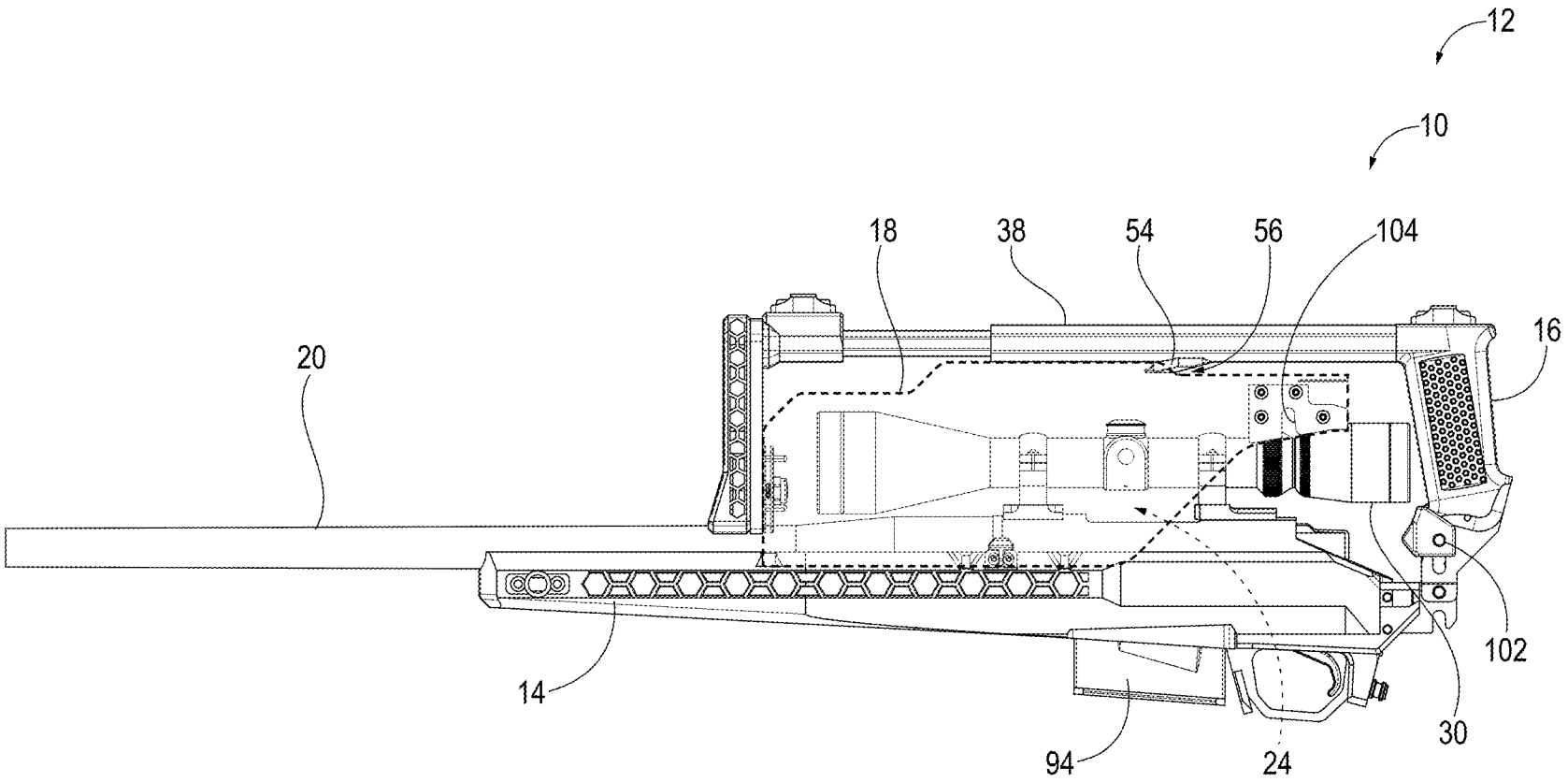
FIG. 14 is a side elevation view of an example of disclosed systems, illustrating a stock in the stowed configuration with the buttstock shown as transparent.
Figure 15:
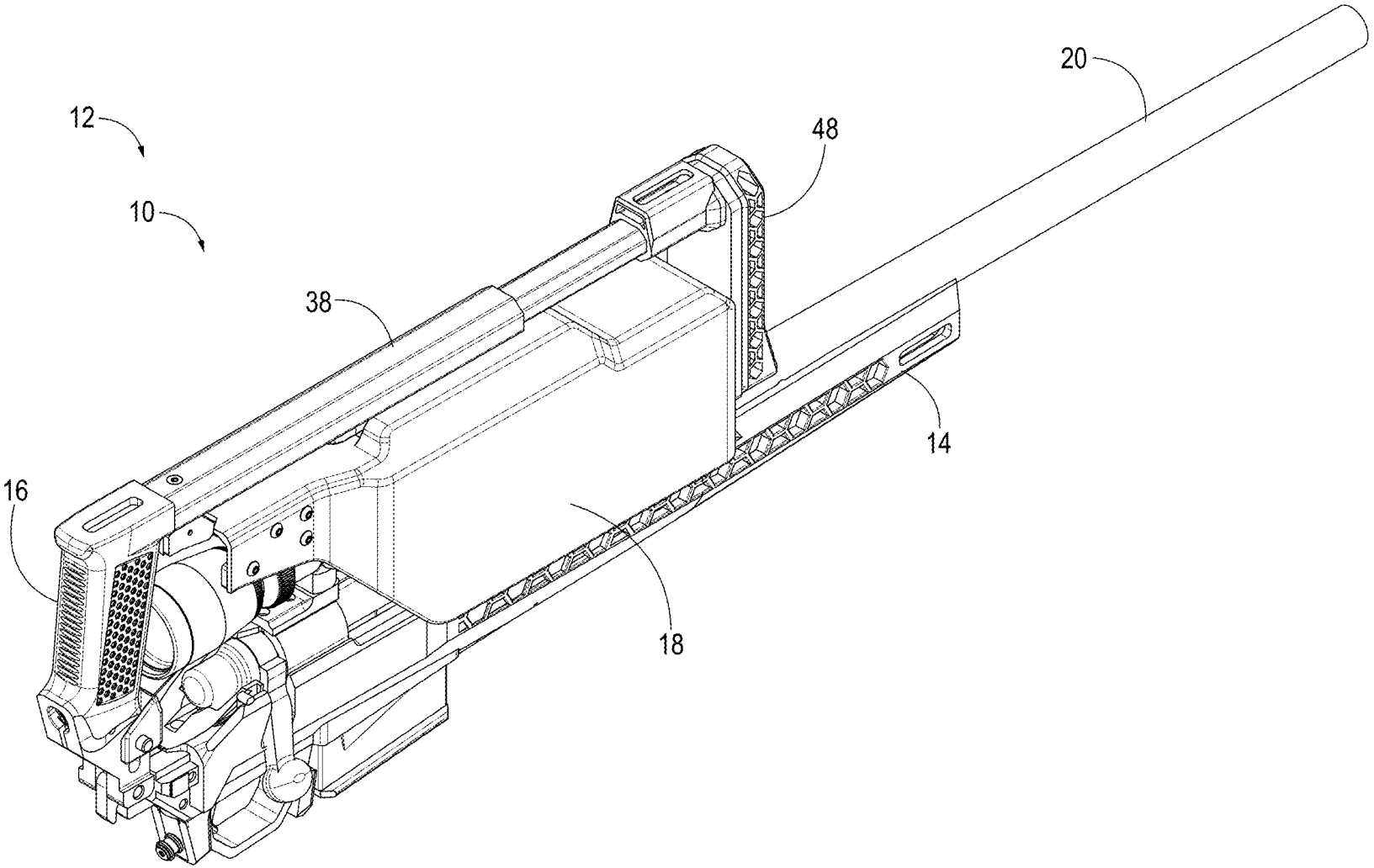
FIG. 15 is a rear perspective view of an example of disclosed systems, shown in the stowed configuration.
Figure 16:
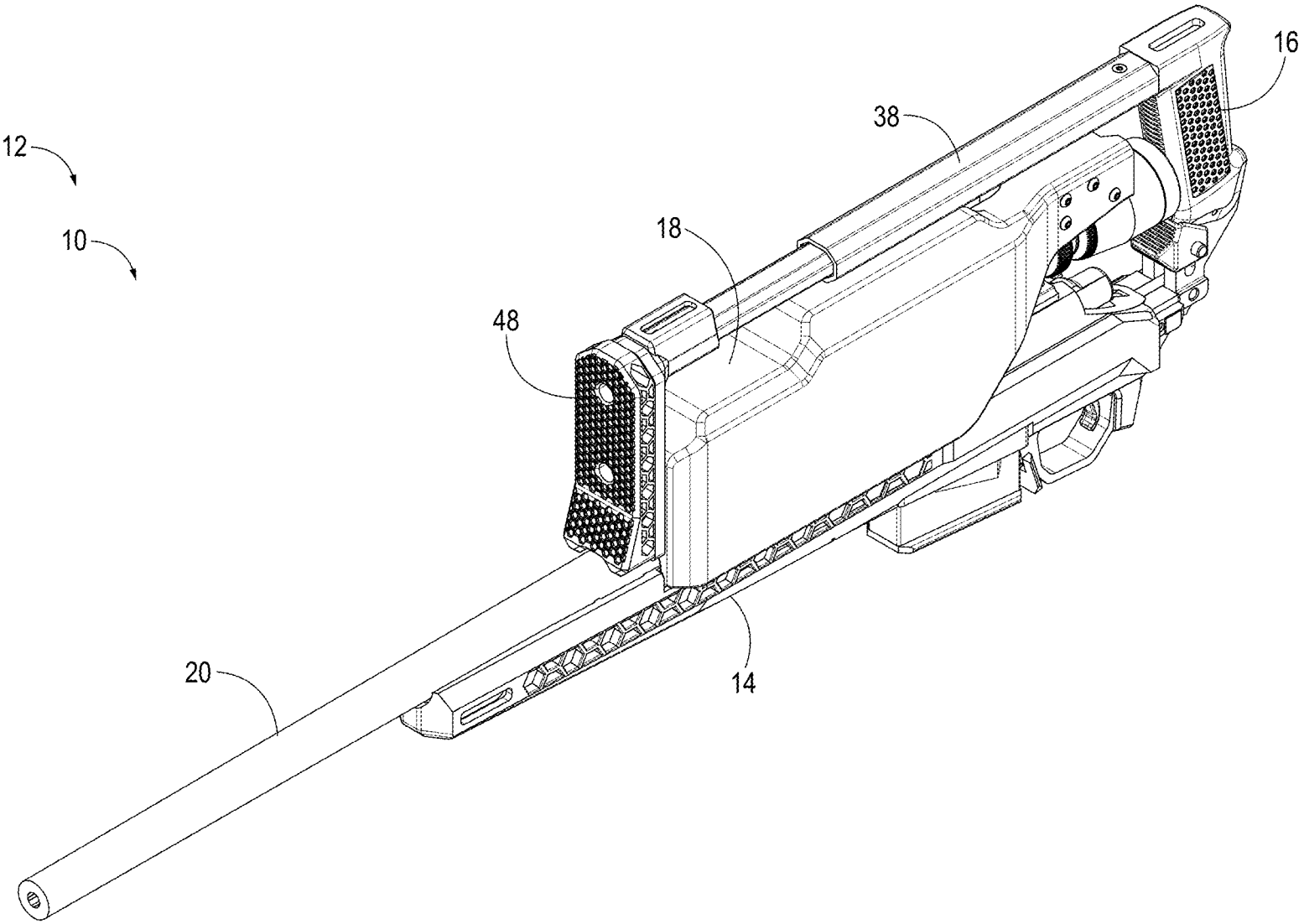
FIG. 16 is a front perspective view of an example of disclosed systems, shown in the stowed configuration.

In the stowed configuration (e.g., as shown in FIG. 13), length 50 of elongate arm 38 may be increased as compared to in the deployed configuration (e.g., as shown in FIG. 5). For example, elongate arm 38 may be at a minimum (e.g., shortened) length 50 in the deployed configuration, while elongate arm 38 may be extended at 78 in the stowed configuration. As illustrated in FIG. 13, buttstock 18 may be configured to surround at least a portion of scope 30 in the stowed configuration, covering one or more attachment points 72 attaching scope 30 to rifle 20. FIG. 14 shows an example of stock 10 in the stowed configuration with buttstock 18 shown transparent to illustrate the portion of scope 30 contained within internal volume 24 of buttstock 18. In some examples, stock 10 covers the entire scope 30, while in some examples, stock 10 covers just a portion of scope 30. Generally, buttstock 18 does not directly contact scope 30 in the stowed configuration, to avoid inadvertently moving or adjusting scope 30. For example, buttstock 18 may be wide enough such that sidewalls 26, 28 of buttstock 18 are spaced wider than the width of scope 30, such that sidewalls 26, 28 do not contact scope 30. Similarly, buttstock 18 may have a height sufficient such that top wall 34 is spaced apart from the top of scope 30 when in the stowed configuration. In some examples, it may be desirable for buttstock 18 to directly contact part of scope 30, though generally buttstock 18 will be sized relative to scope 30 to avoid direct contact with scope 30. In some examples, engagement between buttstock 18 and forestock 14 as described in further detail herein serves to position buttstock 18 relative to scope 30 to facilitate and maintain separation between walls 26, 28, 34 of buttstock 18 and scope 30. FIG. 14 also shows placement (e.g., engagement) of fin 54 at least partially within recess 56 of buttstock 18. FIGS. 15-16 illustrate examples of stock 10 in the stowed configuration shown from different angles. As shown in FIGS. 13-16, buttstock 18 is folded over onto scope 30 of rifle 20 as stock 10 is transitioned from the deployed configuration to the stowed configuration.

Figure 17:
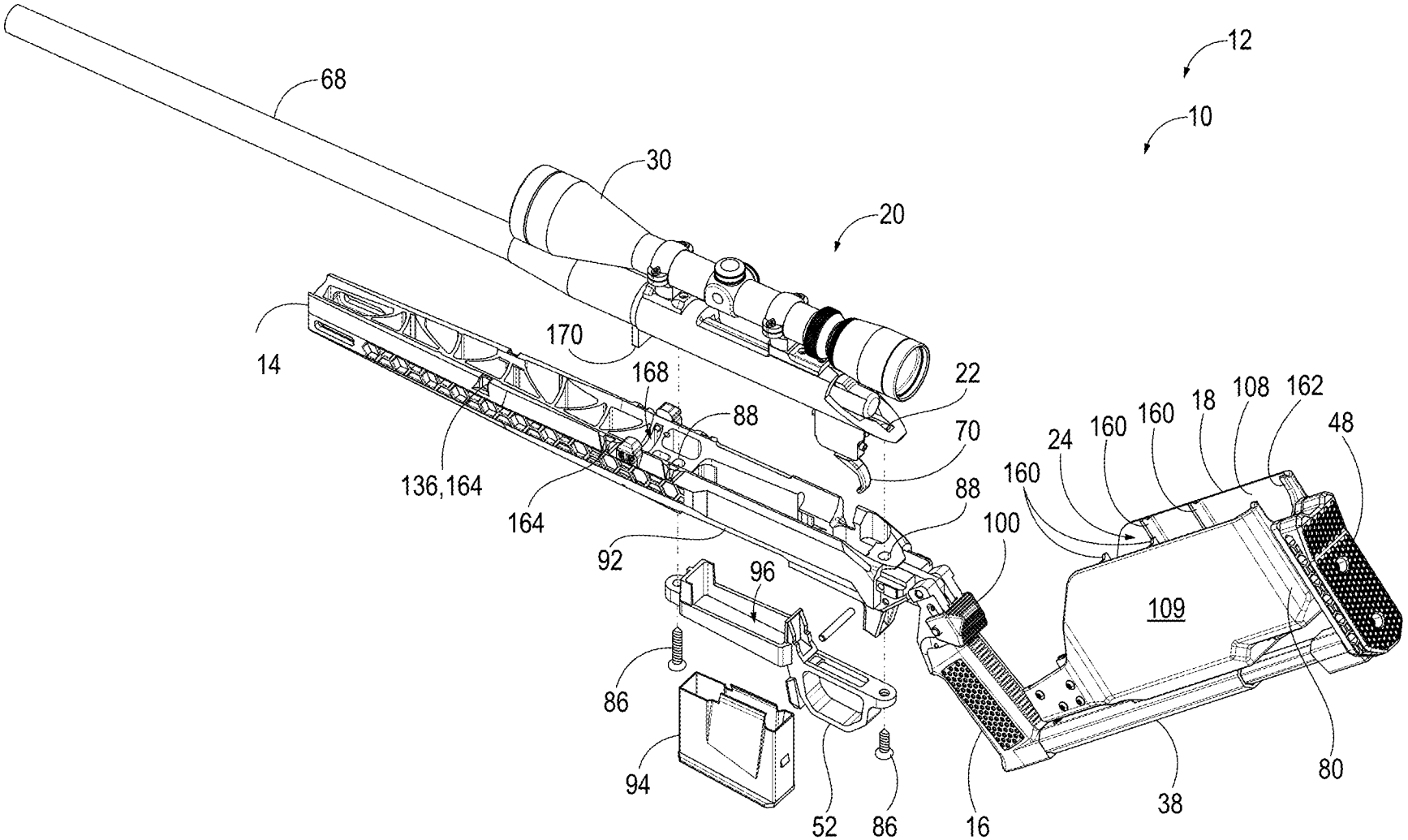
FIG. 17 is an exploded perspective view of an example of systems according to the present disclosure.
Figure 18:
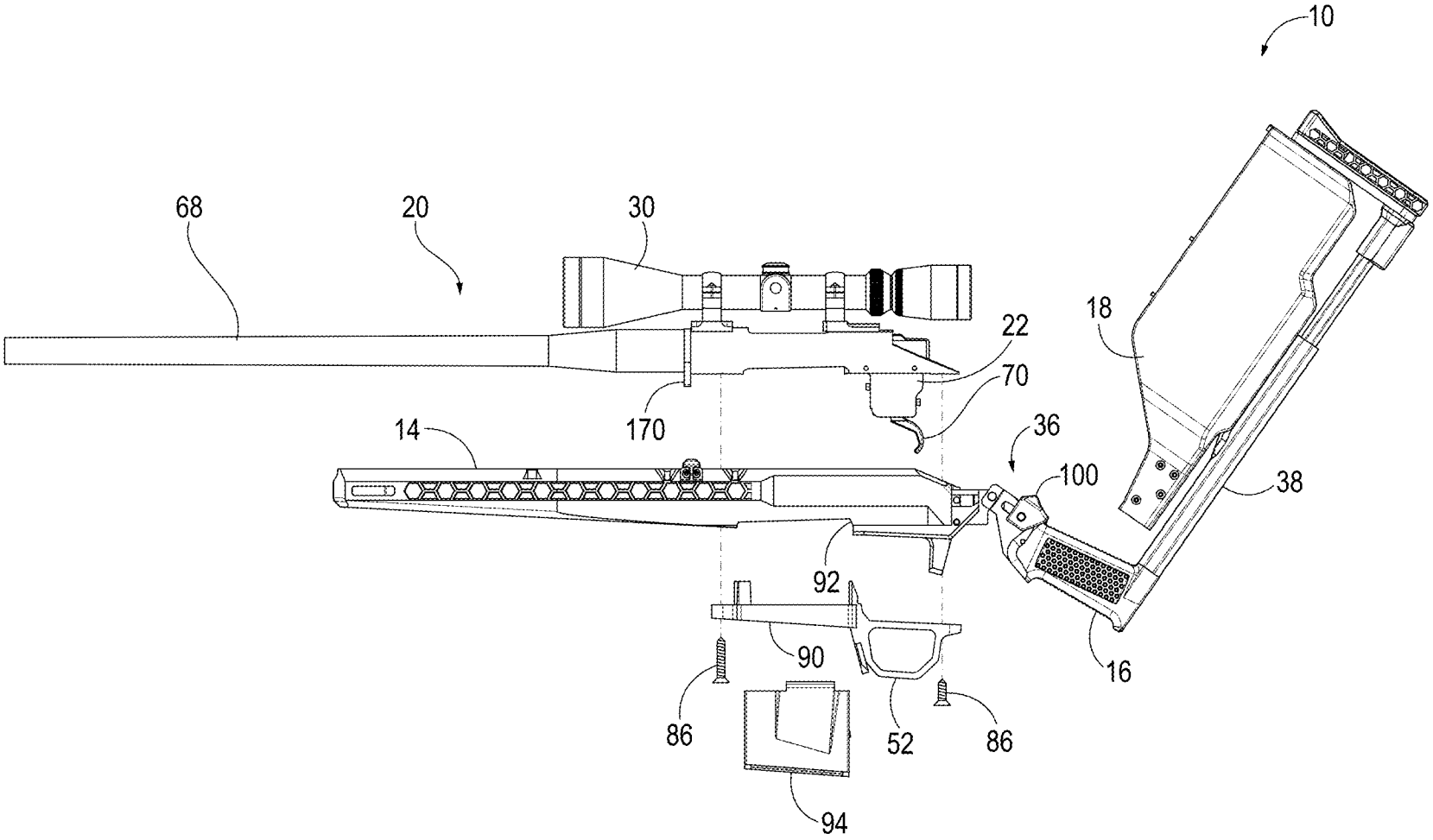
FIG. 18 is an exploded side elevation view of an example of systems according to the present disclosure.

FIGS. 17-18 show exploded views of stock 10 and rifle 20, with stock 10 shown mid-transition between the stowed configuration and the deployed configuration. One or more bolts 86 or other fasteners may be used to couple stock 10 to rifle 20. For example, bolts 86 may extend through trigger guard 52, forestock 14 (e.g., via holes 88 extending through forestock 14 as shown in FIG. 17) and into action 22 to secure rifle 20 to stock 10. When coupled together, trigger 70 of rifle 20 extends through an opening formed in forestock 14 and is seated within trigger guard 52, while an extension 90 of trigger guard 52 engages or rests against an underside 92 of forestock 14. A recoil lug 170 may extend from action 22 into forestock 14, such as into a nesting recess, or a recoil lug slot, 168 configured to receive recoil lug 170. A magazine 94 (see, e.g., FIGS. 14, 28, and 30) also may extend from action 22 and through forestock 14 (e.g., through a hole 98 of forestock 14), as well as through an opening 96 in extension 90 of trigger guard 52. In some examples, one or more portions of forestock 14 forward of recoil lug slot 168 (e.g., distal to recoil lug slot 168) are configured to not contact barrel 68 of rifle 20.

Figure 19:
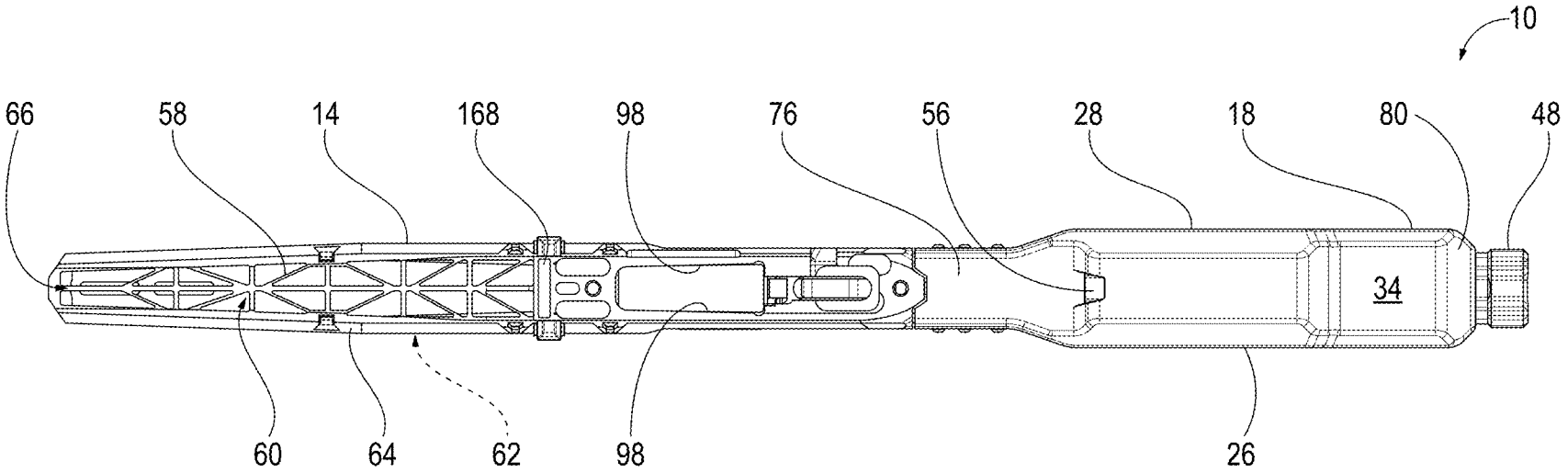
FIG. 19 is a top plan view of an example of a stock according to the present disclosure, shown in the deployed configuration.
Figure 20:
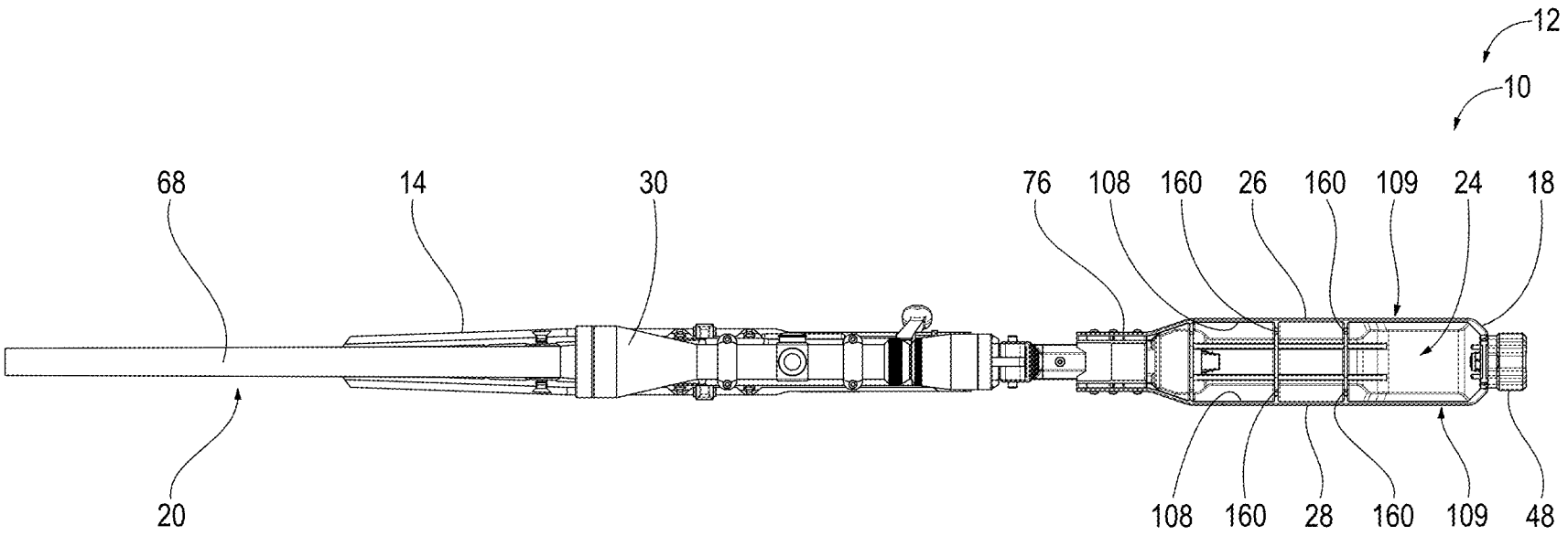
FIG. 20 is a top plan view of an example of a system according to the present disclosure with the stock illustrated in a pivoted position such that its inner surface faces upwards.
Figure 21:
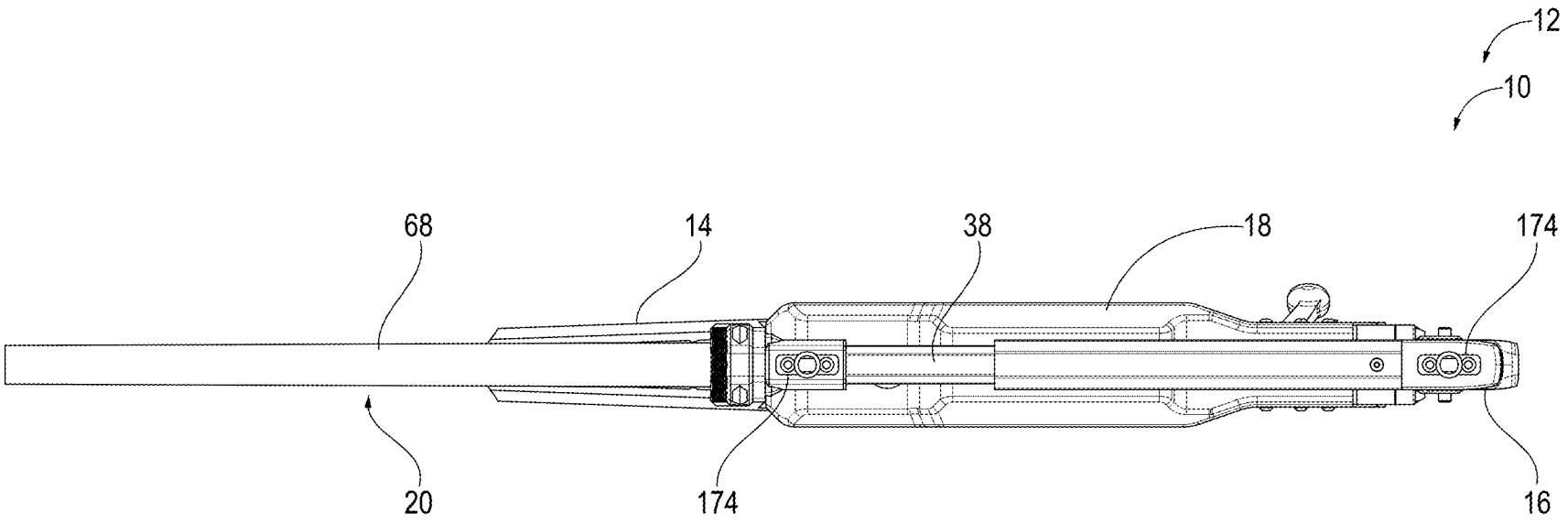
FIG. 21 is a top plan view of an example of a system according to the present disclosure with the stock being in the stowed configuration.

FIG. 19 shows a top plan view of an example of stock 10 in the deployed configuration without a rifle. Forestock 14 in this example includes hole 98 through which magazine 94 of rifle 20 (see FIGS. 17-18) may extend when rifle 20 is engaged with stock 10. FIG. 20 shows a top plan view of an example of stock 10 with rifle 20 engaged with stock 10. In FIG. 20, stock 10 is shown in the process of being transitioned between the stowed configuration and the deployed configuration, with buttstock 18 having been disengaged from grip 16 and rotated 180 degrees, such that internal volume 24 of buttstock 18 faces away from elongate arm 38. FIG. 21 shows a top plan view of an example of stock 10 in the stowed configuration, with buttstock 18 folded over onto forestock 14 to cover at least a portion of scope 30 of rifle 20.

Figure 24:
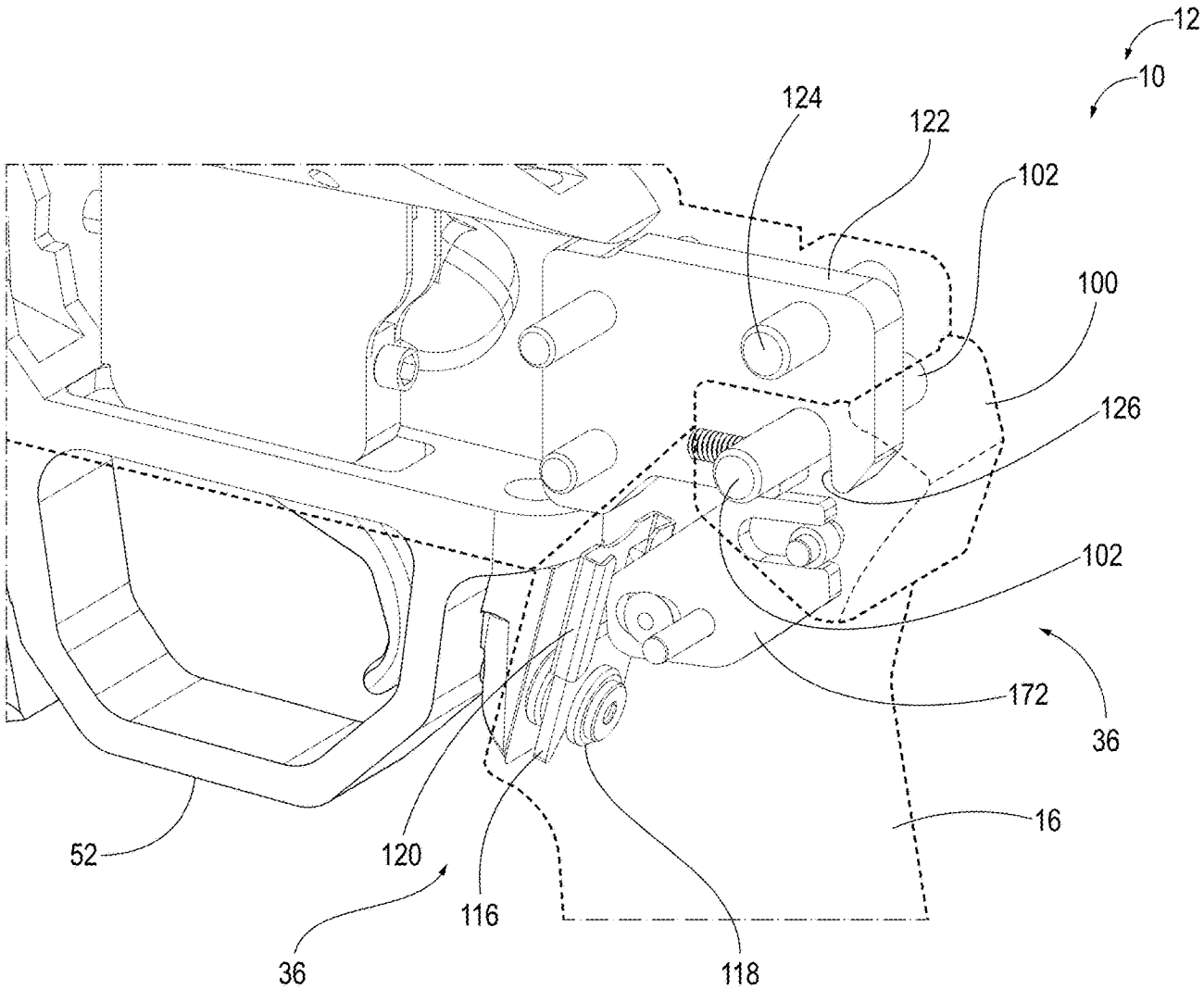
FIG. 24 is a close-up, perspective view of an example of a latching mechanism for engagement of the buttstock and the grip, shown with the thumb slide actuator in the locked position and the buttstock omitted for clarity.
Figure 25:
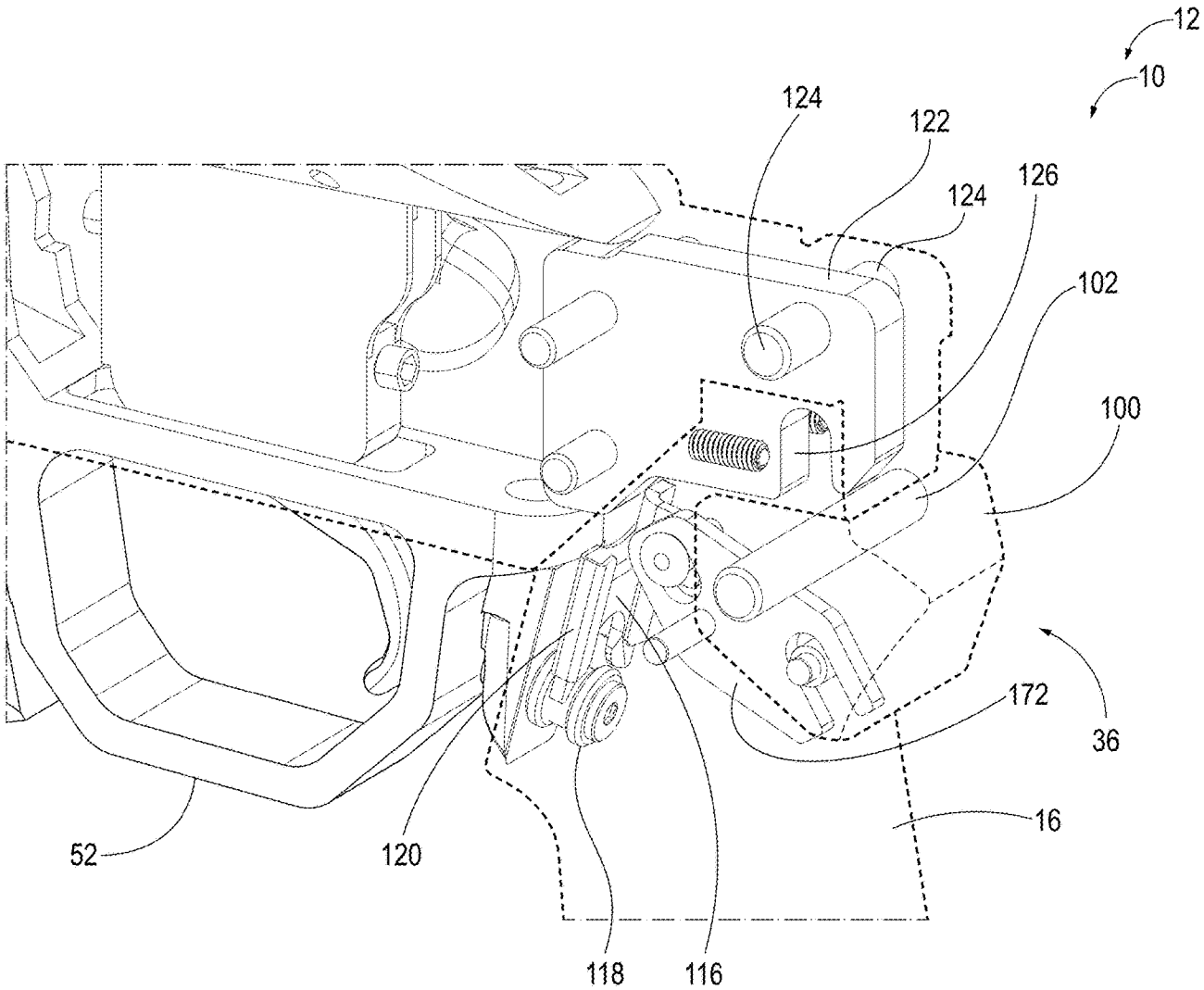
FIG. 25 is a close-up, perspective view of the example of the latching mechanism of FIG. 24, illustrating the thumb slide actuator in the unlocked position and with the buttstock omitted for clarity.
Figure 26:
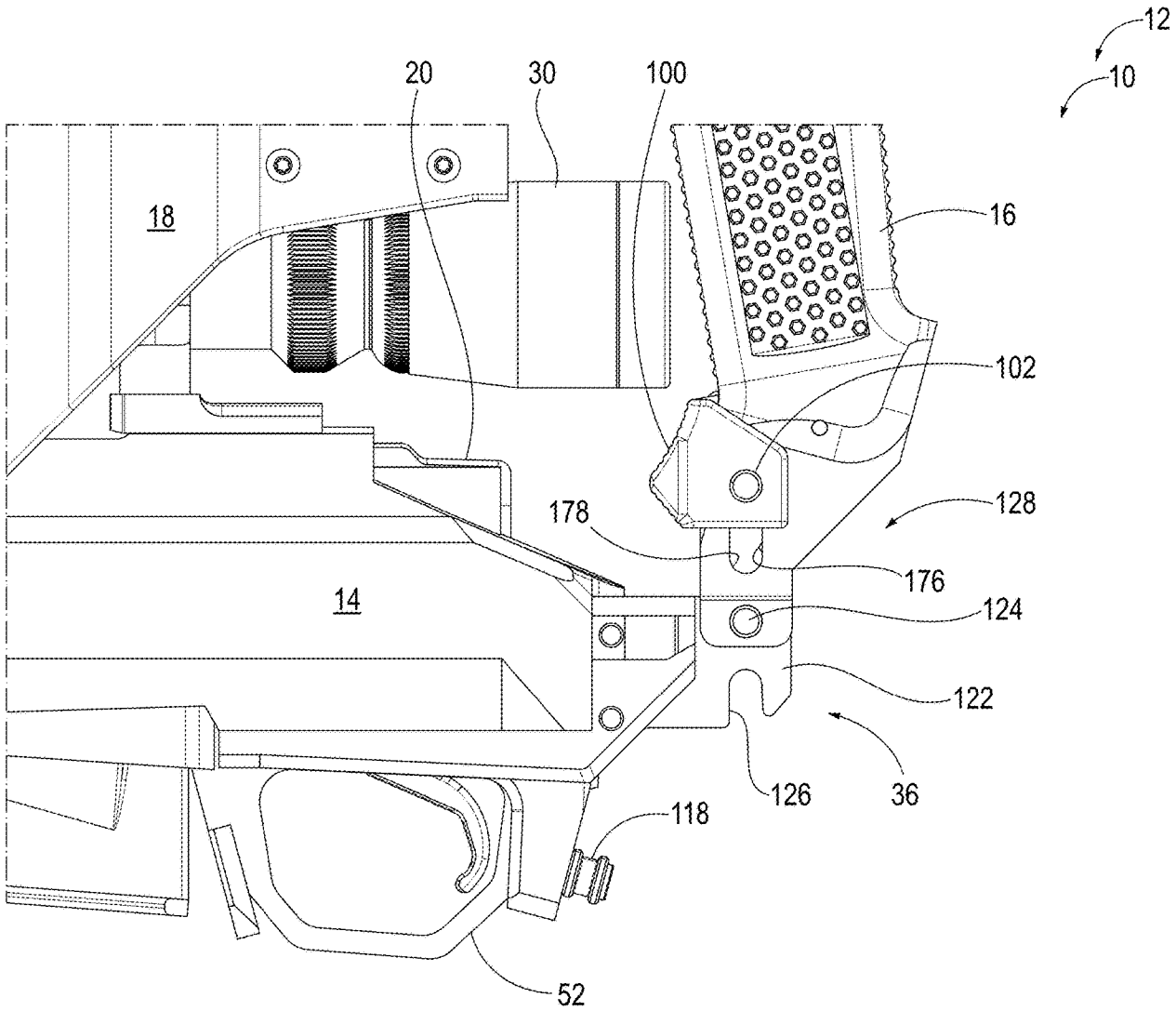
FIG. 26 is a close-up, side elevation view of an example of presently disclosed systems, illustrating the stock in the stowed configuration.

FIGS. 22-26 are close-up views of a portion of examples of stock 10 to illustrate examples of latching mechanisms 36 for engaging buttstock 18 with grip 16 in the deployed configuration, and releasing (e.g., disengaging) buttstock 18 from grip 16 to transition stock 10 to the stowed configuration. Portions of FIGS. 22, 23, 24, and 25 are illustrated transparently (as indicated with dashed lines), and buttstock 18 is not shown in FIGS. 24 and 25 for clarity. FIG. 26 shows a close-up of various components of latching mechanism 36 when stock 10 is in the stowed configuration. Latching mechanism 36 may be configured to secure stock 10 in the deployed configuration and/or in the stowed configuration. In some examples, latching mechanism 36 includes a quick-release mechanism to enable transitioning of stock 10 from the deployed configuration to the stowed configuration. For example, latching mechanism 36 may include a thumb slide actuator 100. Thumb slide actuator 100 may be operatively coupled to grip 16 such that thumb slide actuator 100 is moved with grip 16 when grip 16 and buttstock 18 are rotated to transition stock 10 to the stowed configuration. Due to the movement of grip 16, thumb slide actuator 100 may face proximal end 40 of stock 10 when stock 10 is in the deployed configuration, while thumb slide actuator 100 may face distal end 42 of stock 10 when stock 10 in the stowed configuration. For example, FIG. 3 shows the deployed configuration, in which thumb slide actuator 100 faces proximal end 40 (though thumb slide actuator 100 is largely concealed by wrist 76 of buttstock 18 in the view of FIG. 3; FIG. 6 shows the same positioning of thumb slide actuator 100); and FIG. 13 shows the stowed configuration, in which thumb slide actuator 100 faces distal end 42 of stock 10 after grip 16 and buttstock 18 are rotated to fold into the stowed configuration.

Figure 22:
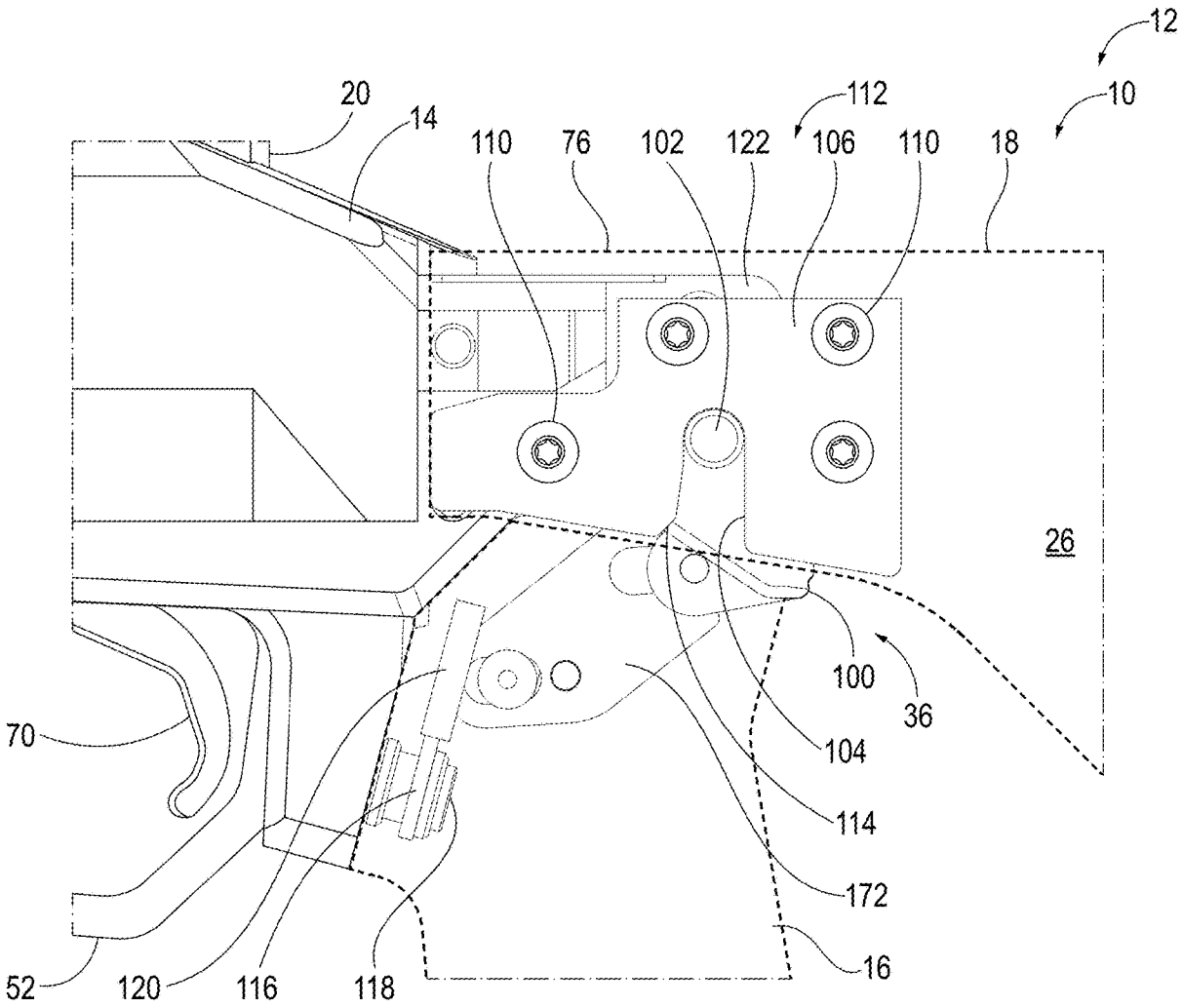
FIG. 22 is a close-up, side elevation view of an example of a latching mechanism for engagement of the buttstock and the grip, shown with a thumb slide actuator in a locked position.
Figure 22A:
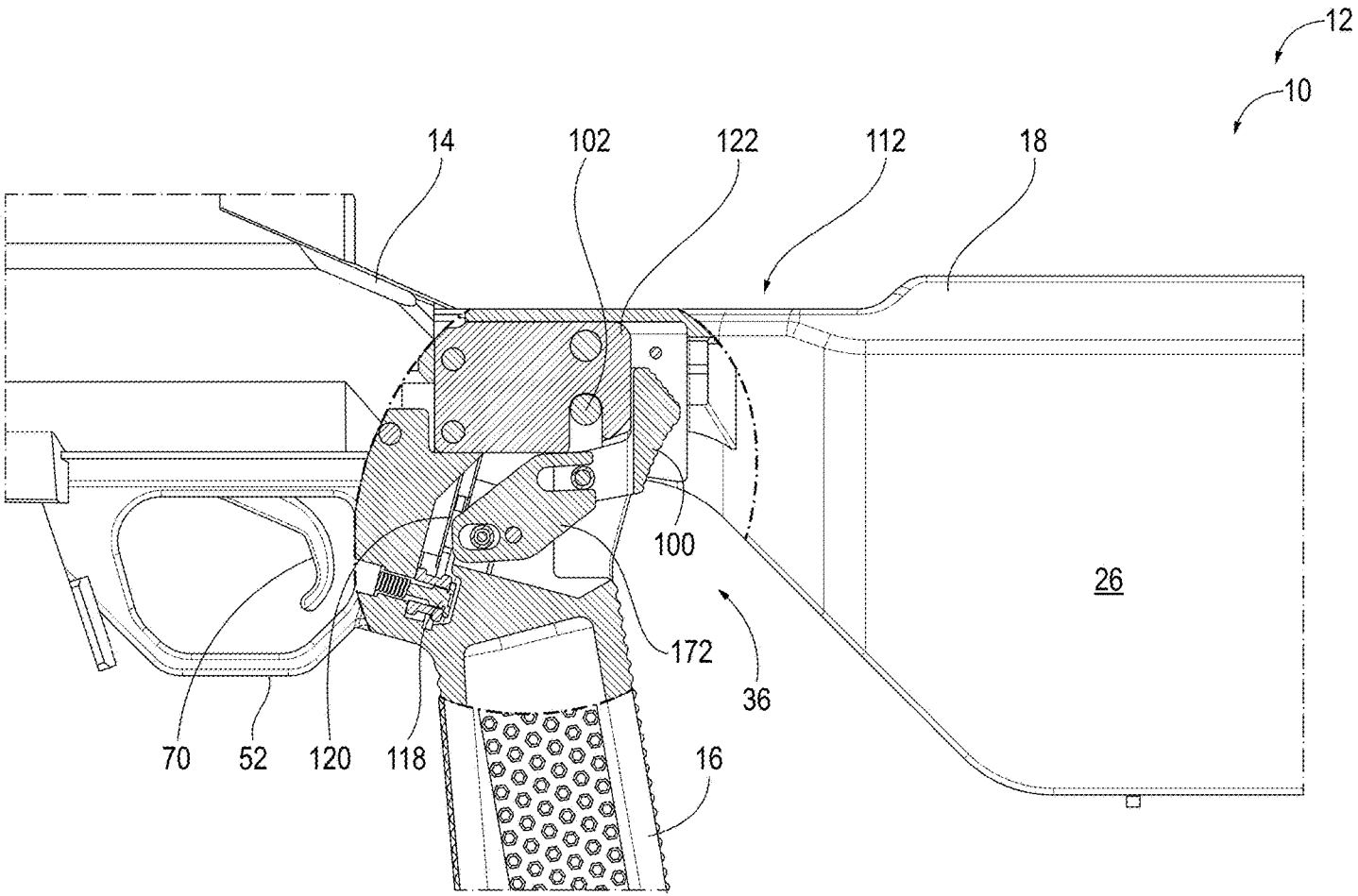
FIG. 22A shows the latching mechanism in wireframe and partial cut away view.
Figure 23:
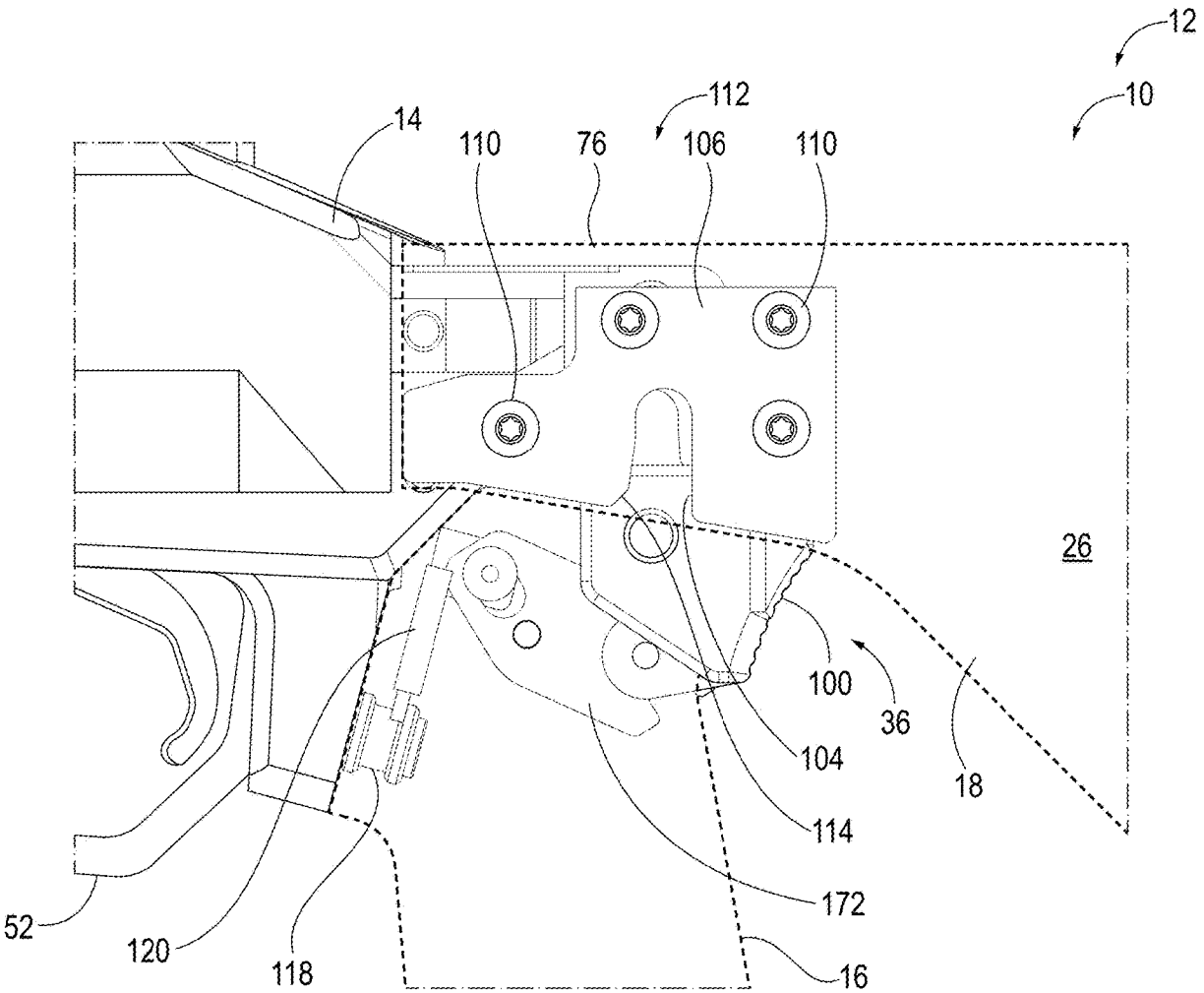
FIG. 23 is a close-up, side elevation view of the latching mechanism of FIG. 22, shown with the thumb slide actuator in an unlocked position.

Thumb slide actuator 100 may be selectively moveable between a locked position (shown in FIGS. 22 and 24) and an unlocked position (shown in FIGS. 23 and 25). In some examples, thumb slide actuator 100 is operatively coupled to grip 16 such that when thumb slide actuator 100 is moved between the locked position and the unlocked position, it is translated with respect to grip 16 but remains coupled to grip 16. For example, thumb slide actuator 100 is visible coupled to grip 16 in various positions of stock 10 in FIGS. 6, 10, 13, and 17, among others. Thumb slide actuator 100 is generally in the locked position of FIG. 22 (and FIGS. 22A and 24) when stock 10 is in the deployed configuration. In this locked position, thumb slide actuator 100 may be positioned at least partially within buttstock 18, such as at least partially within internal volume 24 of wrist 76 of buttstock 18. Thus, thumb slide actuator 100 is positioned at least partially within wrist 76 of buttstock 18 when stock 10 is in the deployed configuration, though is generally not positioned within internal volume 24 when stock 10 is in the stowed configuration. When thumb slide actuator 100 is in the unlocked position (FIGS. 23, 23A, and 25), grip 16 is disengaged from trigger guard 52 and buttstock 18, such that grip 16 can be rotated with respect to forestock 14 to transition stock 10 to the stowed configuration. In some examples, stock 10 may include one or more spring-loaded ball detents 176 inside a slot 178 in grip 16 that hold or bias thumb slide actuator 100 in the locked position (best seen in FIG. 26). Slot 178 may be configured to constrain thumb slide actuator 100 and pin 102 that extends through slot 178

Figure 23A:
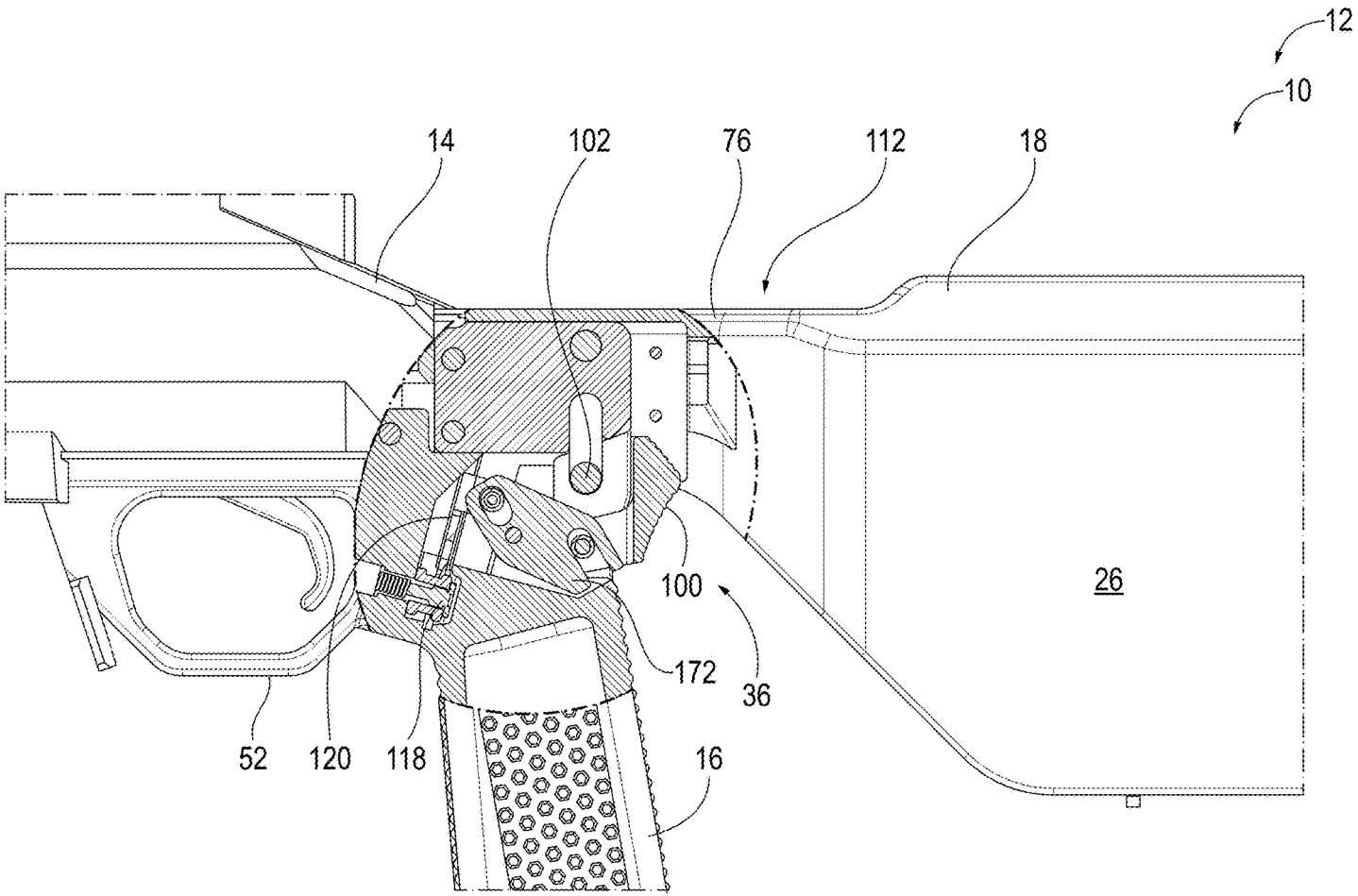
FIG. 23A shows the latching mechanism in wireframe and partial cut away view.

In some examples, thumb slide actuator 100 must be moved to the unlocked position shown in FIG. 23 and FIG. 23A in order to release buttstock 18 from grip 16, before stock 10 can be transitioned to the stowed configuration. Thumb slide actuator 100 disengages or unlocks buttstock 18 from grip 16 when thumb slide actuator 100 is pulled down to the unlocked position. Likewise, thumb slide actuator 100 of latching mechanism 36 engages or locks buttstock 18 to grip 16 when thumb slide actuator 100 is pushed up to the locked position. To accomplish engaging or disengaging buttstock 18 to/from grip 16, thumb slide actuator 100 may include a locking pin 102 that travels into a wrist slot 104 of wrist 76 as thumb slide actuator 100 is pushed up into the locked position, and that travels out of wrist slot 104 as thumb slide actuator 100 is pushed down into the unlocked position. Thus, when thumb slide actuator 100 is in the locked position, locking pin 102 extends through wrist slot 104 (as seen in FIGS. 22 and 22A), while when thumb slide actuator 100 is in the unlocked position, locking pin 102 is positioned outside of wrist slot 104 (as seen in FIGS. 23 and 23A). Wrist slots 104 can also be seen in FIGS. 9 and 14.

Wrist slots 104 are generally formed in or inside buttstock 18, such as within internal volume 24 of wrist 76 of buttstock 18. In some examples, wrist slots 104 may be formed by bolting (e.g., via bolts 110), adhering, or otherwise fastening wrist pieces 106 to inner surfaces 108 of sidewalls 26, 28 within wrist 76 of buttstock 18. Wrist slots 104 may be defined by the thickness of wrist pieces 106. In other examples, wrist slots 104 may be formed directly in inner surfaces 108 of sidewalls 26, 28 within wrist 76 (e.g., integrally formed with buttstock 18). Wrist slot 104 may thus be said to have a first slot portion 104*a* on a first inner surface 108*a* of first sidewall 26 and a second slot portion 104*b* on a second inner surface 108*b* of second sidewall 28 (best seen in FIG. 9). Wrist slot 104 may be positioned within a distal portion 112 of buttstock 18 (wrist slots 104 are also seen in FIG. 14).

With continued reference to FIGS. 22-26, locking pin 102 may be integrally formed with thumb slide actuator 100, or locking pin 102 may extend through thumb slide actuator 100 or otherwise be coupled to thumb slide actuator 100 such that movement of thumb slide actuator 100 causes corresponding movement of locking pin 102. Locking pin 102 has a longitudinal pin axis that is substantially perpendicular to a longitudinal stock axis of buttstock 18. In some examples, locking pin 102 is substantially orthogonal to a longitudinal forestock axis of forestock 14. In some examples, wrist slot 104 includes a ramp 114 configured to cause movement of buttstock 18 towards forestock 14 (e.g., towards distal end 42 of stock 10), via movement of locking pin 102 along ramp 114 and into wrist slot 104. In this manner, moving thumb slide actuator 100 to the locked position can draw buttstock 18 (e.g., wrist 76) tight against forestock 14 due to engagement between locking pin 102 and ramp 114 of wrist slot 104, thereby at least substantially locking linear motion of buttstock 18 relative to forestock 14 (e.g., along the longitudinal axis of rifle 20).

In some examples, moving thumb slide actuator 100 to the unlocked position disengages grip 16 from buttstock 18 and also disengages grip 16 from trigger guard 52, such that grip 16 can be pivoted with respect to trigger guard 52 and forestock 14 (e.g., as seen in FIGS. 10-13 as stock 10 is transitioned from the deployed configuration to the stowed configuration, or to the deployed configuration from the stowed configuration). To accomplish this, latching mechanism 36 may include a grip slide latch 116. With reference to all of FIGS. 22-25, stock 10 may be configured such that movement of thumb slide actuator 100 to the unlocked position causes grip slide latch 116 to disengage from trigger guard 52. For example, when thumb slide actuator 100 is in the locked position (FIGS. 22 and 24), grip slide latch 116 is engaged with trigger guard 52. On the other hand, when thumb slide actuator 100 is in the unlocked position (FIGS. 23 and 25), grip slide latch 116 is disengaged from trigger guard 52. For example, movement of thumb slide actuator 100 to the unlocked position may cause grip slide latch 116 to slide-off of a stud 118 extending from trigger guard 52, via a mechanical linkage 172 connecting grip slide latch 116 to thumb slide actuator 100. As thumb slide actuator 100 is moved downward to the unlocked position, this movement causes mechanical linkage 172 to pivot, due to the proximal portion of mechanical linkage 172 that is coupled to thumb slide actuator 100. When mechanical linkage 172 is pivoted in this manner, the distal portion of mechanical linkage 172 moves upwards, moving grip slide latch 116 with it, due to the coupling between the distal portion of mechanical linkage 172 and grip slide latch 116. In other words, mechanical linkage 172 serves to mechanically link grip slide latch 116 to thumb slide actuator 100, such that movement of thumb slide actuator 100 causes opposing movement of grip slide latch 116.

Grip slide latch 116 is shown having been slid off of stud 118 (thereby disengaging grip slide latch 116 from trigger guard 52 by disengaging from stud 118) in FIGS. 23 and 25. Grip 16 is configured to pivot with respect to forestock 14 and trigger guard 52 when grip slide latch 116 is released or disengaged from stud 118 of trigger guard 52 (and locking pin 102 is positioned outside of a bracket slot 126 of a bracket 122 of forestock 14 via movement of thumb slide actuator 100 to the unlocked position). Engagement between grip slide latch 116 and stud 118 may be configured to at least substantially prevent such rotation of grip 16 when the two are engaged, thereby locking grip 16 relative to trigger guard 52 and forestock 14. In some examples, grip slide latch 116 slides within a channel, or sleeve 120 configured to maintain alignment between grip slide latch 116 and stud 118 and/or reduce friction and reduce wear that may otherwise occur if grip slide latch 116 were to slide inside a channel in the grip material of grip 16.

Additionally or alternatively, stock 10 may include a bracket 122 that pivotally couples grip 16 to forestock 14 (e.g., via a pivot pin 124). In some examples, bracket 122 is part of forestock 14 and/or fixedly coupled to forestock 14. Locking pin 102 of thumb slide actuator 100 may be positioned within bracket slot 126 of bracket 122 when thumb slide actuator 100 is in the locked position (in addition to locking pin 102 being positioned within wrist slot 104), as best seen in FIG. 24. When thumb slide actuator 100 is moved to the unlocked position, locking pin 102 may be moved out of bracket slot 126 (in addition to locking pin 102 being moved out of wrist slot 104), as best seen in FIG. 25. In some examples, bracket slot 126 may be ramped (e.g., may include a bracket slot ramp similar to ramp 114 of wrist slot 104) such that bracket slot 126 may be configured to draw grip 16 against forestock 14 and trigger guard 52 when thumb slide actuator 100 is in the locked position, via movement of locking pin 102 along the ramp and into bracket slot 126. When thumb slide actuator 100 is in the locked position and locking pin 102 is positioned within bracket slot 126, rotation of grip 16 is at least substantially locked with respect to forestock 14 because locking pin 102 is constrained within bracket slot 126, which at least substantially prevents grip 16 from being moved away from forestock 14.

While engagement between grip slide latch 116 and stud 118 and engagement between locking pin 102 and bracket slot 126 both serve to constrain rotation of grip 16 with respect to forestock 14, the position of grip slide latch 116 is farther from the axis of rotation of grip 16 (e.g., farther from pivot pin 124) than is the position of locking pin 102 is, which may increase the strength and rigidity of stock 10. Thus, a single motion of moving thumb slide actuator 100 to the locked position can both draw buttstock 18 tight against forestock 14 (via locking pin 102 moving into wrist slot 104), and also lock grip 16 with respect to forestock 14 to prevent rotation of grip 16 with respect to forestock 14 and trigger guard 52 in this position. Likewise, a single motion of moving the thumb slide actuator to the unlocked position can both result in disengaging buttstock 18 from forestock 14, and also release grip 16 from forestock 14 and trigger guard 52 to enable rotation of grip 16 with respect to forestock 14 and trigger guard 52.

Pivot pin 124 extends through grip 16 and forestock 14 (e.g., bracket 122 of forestock 14), with grip 16 being configured to pivot about pivot pin 124 with respect to forestock 14 to transition stock 10 between the deployed configuration and the stowed configuration. In some examples, bracket 122 and forestock 14 may be integrally formed (e.g., a monolithic machined or additively manufactured piece), while in other examples bracket 122 may be a separate piece that is coupled to forestock 14. For example, a separate bracket 122 made of aluminum and/or titanium may be used to increase the rigidity of bracket slot 126 as compared to forming bracket 122 from printed nylon or other materials of forestock 14 (though an additively manufactured bracket 122 is within the scope of the present disclosure, as noted above).

In some examples, stock 10 includes a linkage configured to force the safety of rifle 20 into the safe position when stock 10 is in the stowed configuration. For example, a spring-loaded linkage may be configured to position the safety in the safe position in the absence of stock 10 in the absence of wrist 76 being coupled to forestock 14, while stock 10 may be configured to relieve the spring force through a rod to allow the safety to stay in the fire position. Additionally or alternatively, a linkage that is configured to force the safety to its safe position with rotation of the grip to the stowed configuration may be included.

Figure 27:
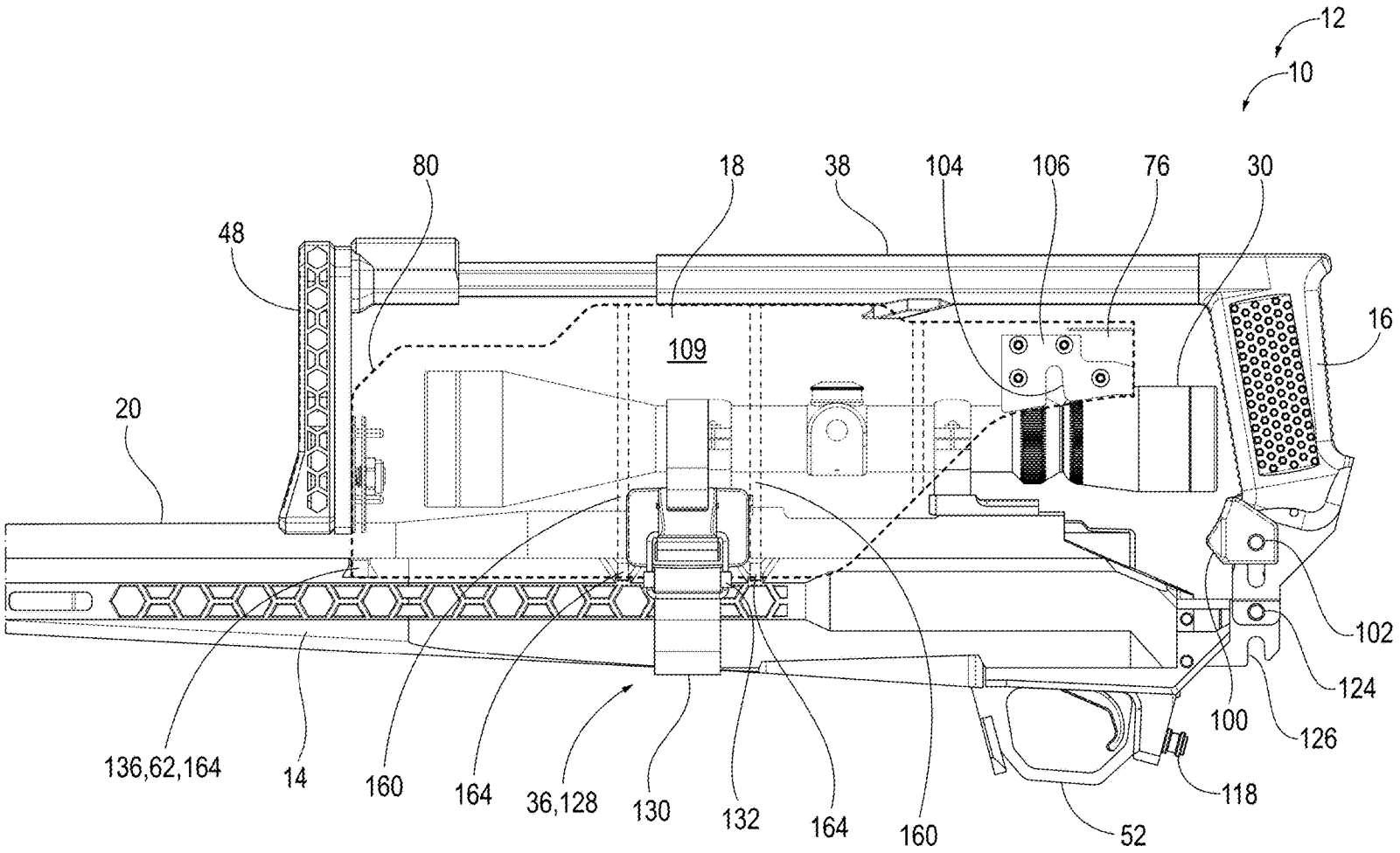
FIG. 27 is a side elevation view of an example of presently disclosed systems illustrating the stock in the stowed configuration and with the buttstock shown as transparent.
Figure 27A:
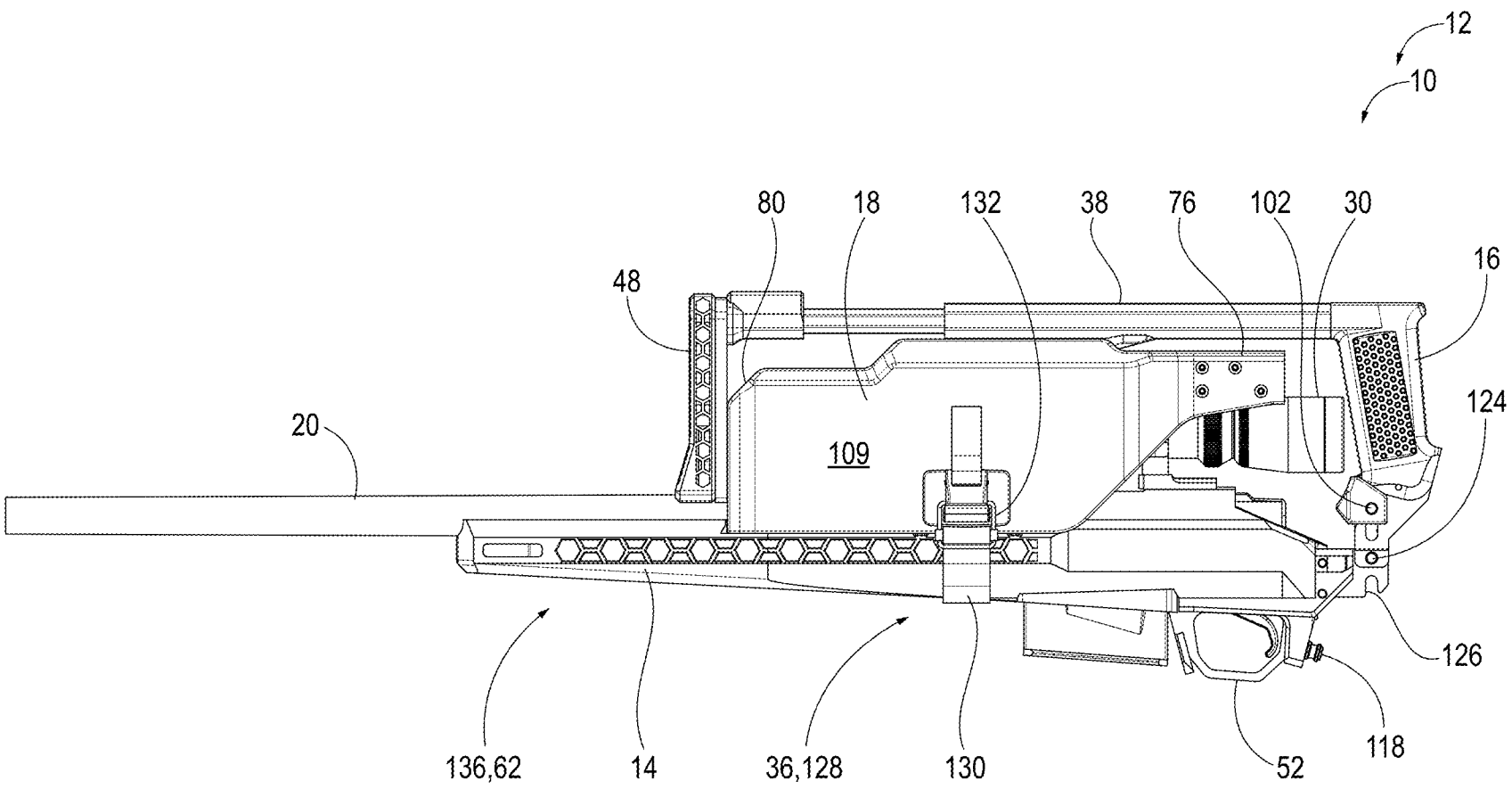
FIG. 27A is a wireframe version of the stock of FIG. 27.

Latching mechanism 36 may additionally or alternatively include a forestock latch 128 configured to secure buttstock 18 to forestock 14 when stock 10 is in the stowed configuration. FIGS. 27-30 illustrate different, non-exclusive examples of forestock latch 128 that may be used with any presently disclosed stocks 10, with buttstock 18 being illustrated transparently in FIGS. 27, 28, 28A, 29, and 30. For example, FIGS. 27 and 27A illustrate forestock latch 128 in the form of a strap 130 and/or buckle 132 configured to secure buttstock 18 to forestock 14 when stock 10 is in the stowed configuration. Buckle 132 may be a buckle, a snap, a magnetic catch, or other selectively releasable mechanism for securing strap 130. Buckle 132 may be coupled to one sidewall of buttstock 18, while an end of strap 130 may be coupled to the opposite sidewall of buttstock 18. To secure buttstock 18 to forestock 14 in the stowed confirmation, strap 130 may be coupled to buttstock 18 and then wrapped at least partially around forestock 14, cinched or pulled tight, and secured in place via buckle 132. To release, strap 130 may be loosened and/or unbuckled (e.g., removed) from buckle 132 to allow buttstock 18 to be moved away from forestock 14 to transition back to the deployed configuration. In the deployed configuration, strap 130 may be wrapped around elongate arm 38 and secured thereto to keep strap 130 out of the way during use.

Figure 28:
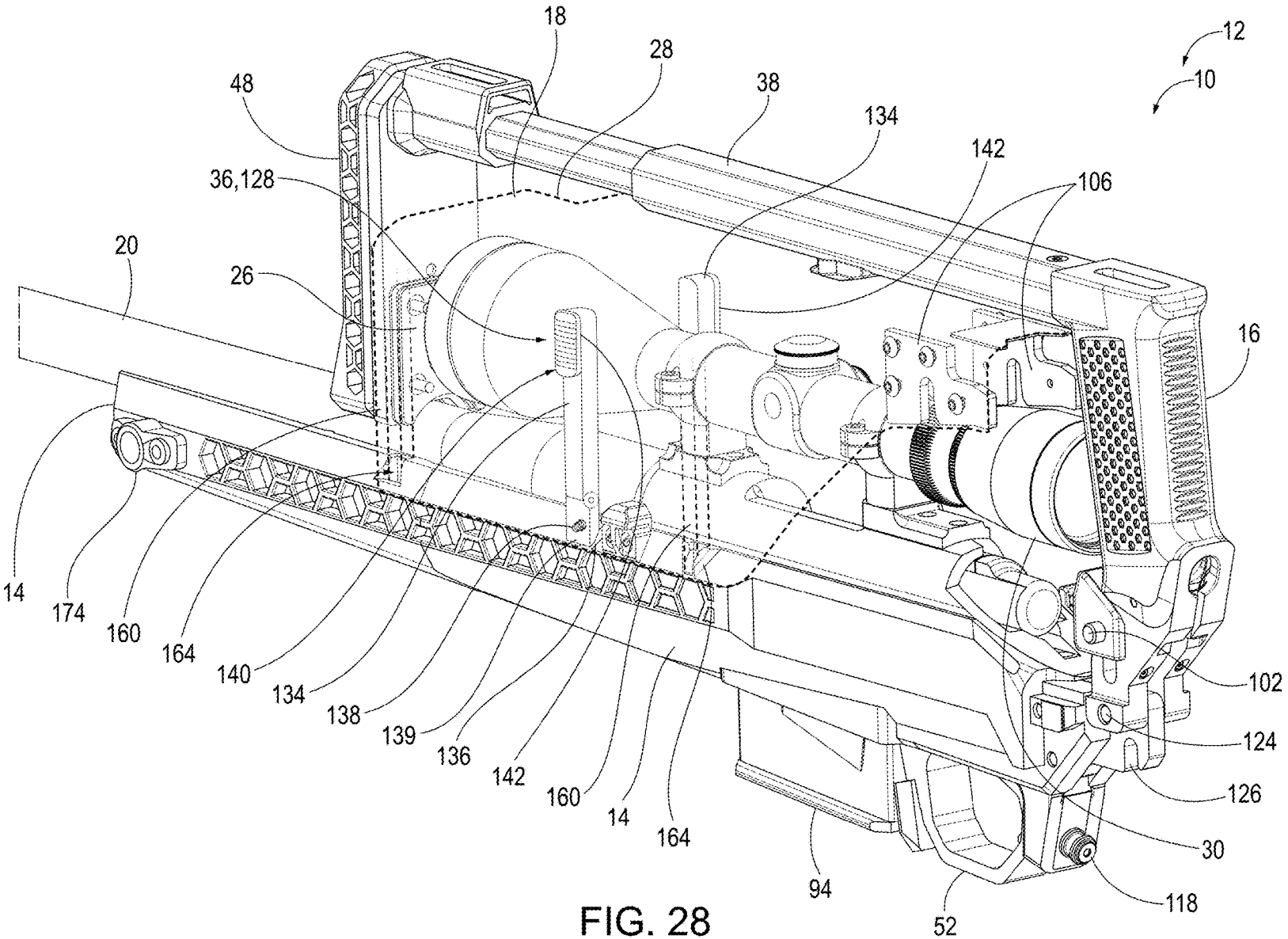
FIG. 28 is a rear perspective view of an example of presently disclosed systems, illustrating the stock in the stowed configuration, and with the buttstock shown as transparent.
Figure 28A:
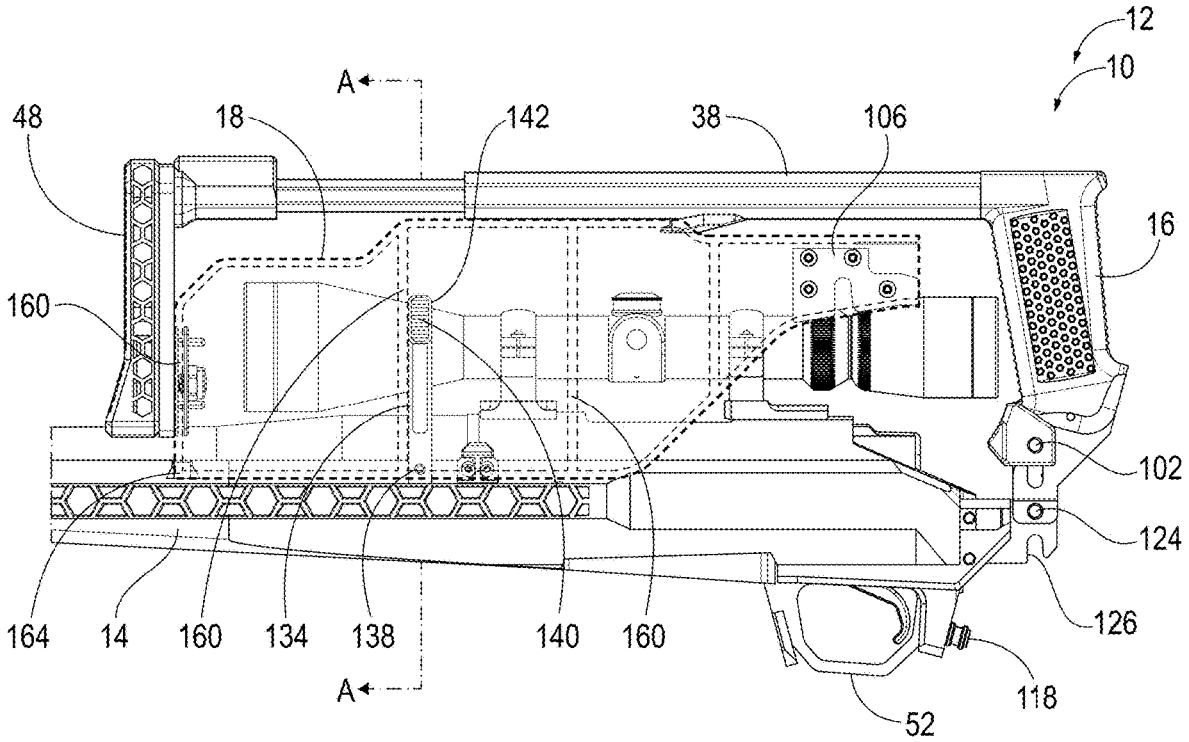
FIG. 28A is a side elevation wireframe view of the stock of FIG. 28.
Figure 28B:
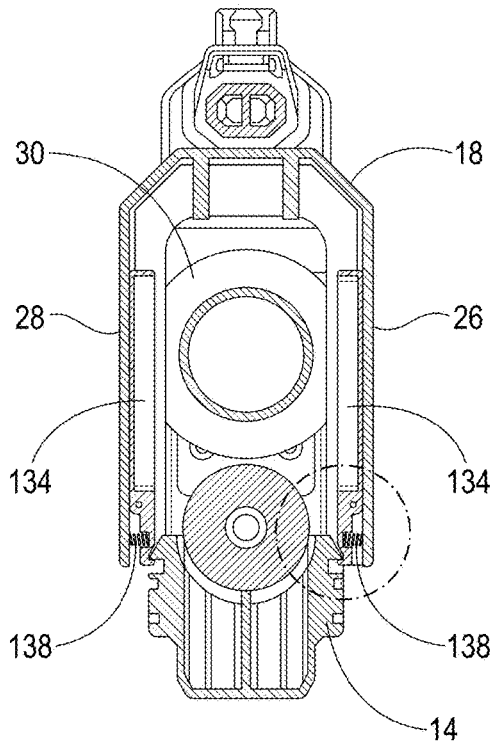
FIG. 28B is a section view of the system of FIG. 28A, taken along line A-A in FIG. 28A.
Figure 28C:
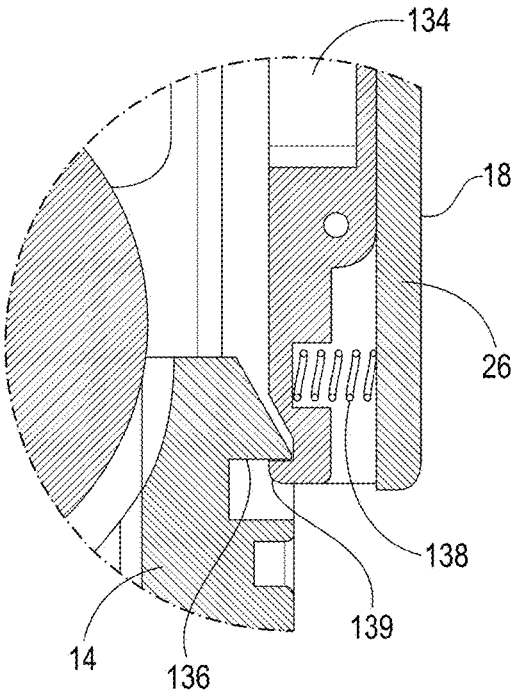
FIG. 28C is a close-up view of a portion of FIG. 28B, as indicated by the callout in FIG. 28B.
Figure 29:
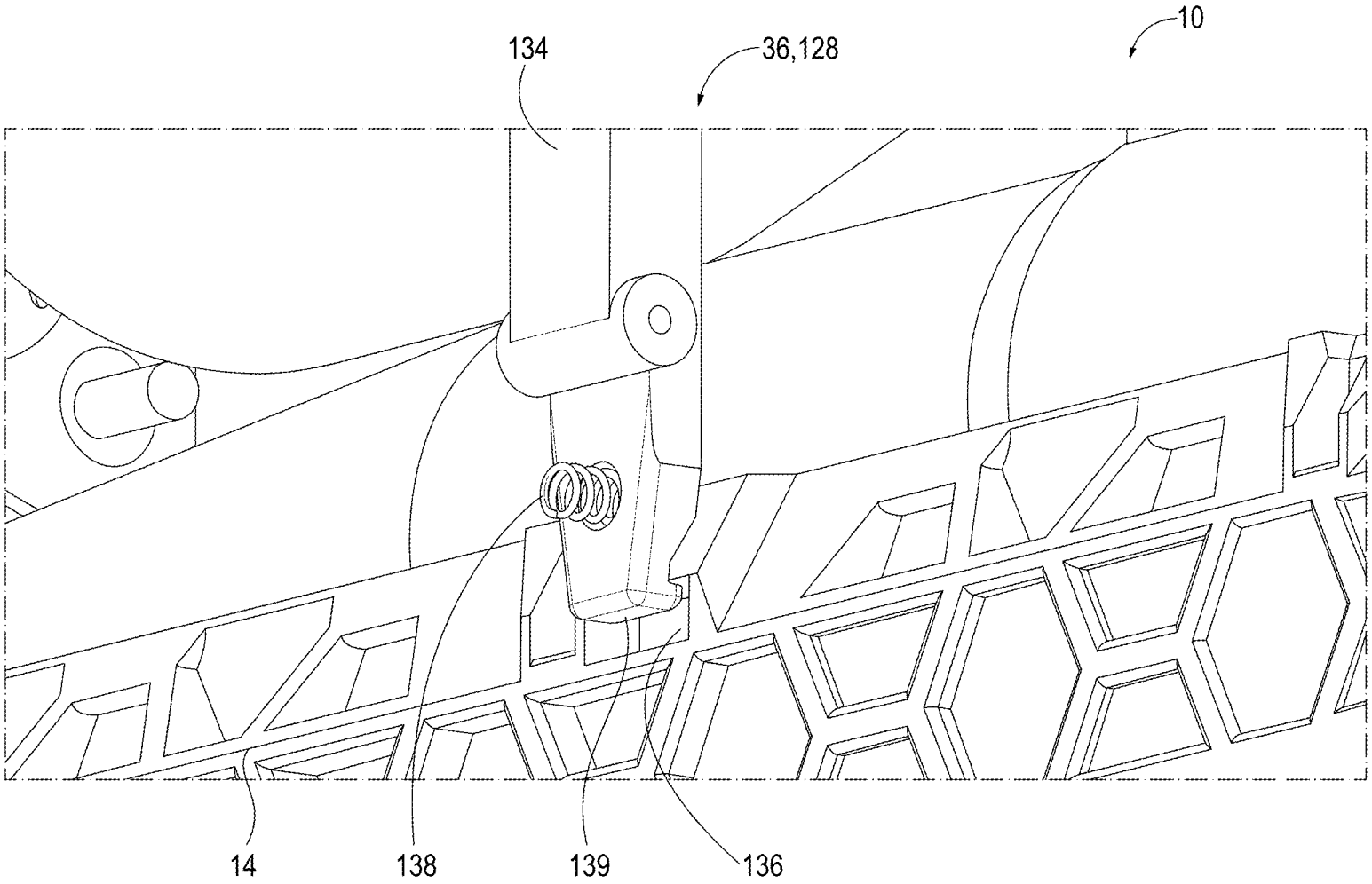
FIG. 29 is a close-up, perspective view of a portion of the latching mechanism of the system of FIG. 28.

FIGS. 28 and 28A-28C show an example of forestock latch 128 having a spring-biased lever arm 134 that clips into a recess, a groove, or a catch 136 of forestock 14. FIGS. 28C and 29 show a close-up view of a portion of spring-biased lever arm 134 (which is also shown in section view in FIG. 28B), showing a spring 138 that may be configured to bias a lip, a flange, or a projection 139 of spring-biased lever arm 134 into catch 136 of forestock 14, thereby securing buttstock 18 to forestock 14 in the stowed configuration. Latching mechanism 36 may include such a forestock latch 128 formed in each sidewall 26, 28 of buttstock 18 (e.g., on each side of buttstock 18 as seen in FIG. 28). A portion 140 of each spring-biased lever arm 134 may extend through a respective aperture 142 of buttstock 18 to effectively create a button configured to be actuated to release a respective spring-biased lever arm 134 from a respective catch 136 on forestock 14. When spring-biased lever arms 134 are released from catches 136 of forestock 14, buttstock 18 may be moved away from forestock 14 to unfold buttstock 18 and grip 16 to transition stock 10 to the deployed configuration. While the example of FIG. 28 shows two spring-biased lever arms 134 (e.g., one on each side of buttstock 18), other examples of forestock latch 128 may include more or fewer spring-biased lever arms 134, such as a spring-biased lever arm 134 on just one sidewall of buttstock 18, or multiple spring-biased lever arms 134 on one or both sides of buttstock 18.

Figure 30:
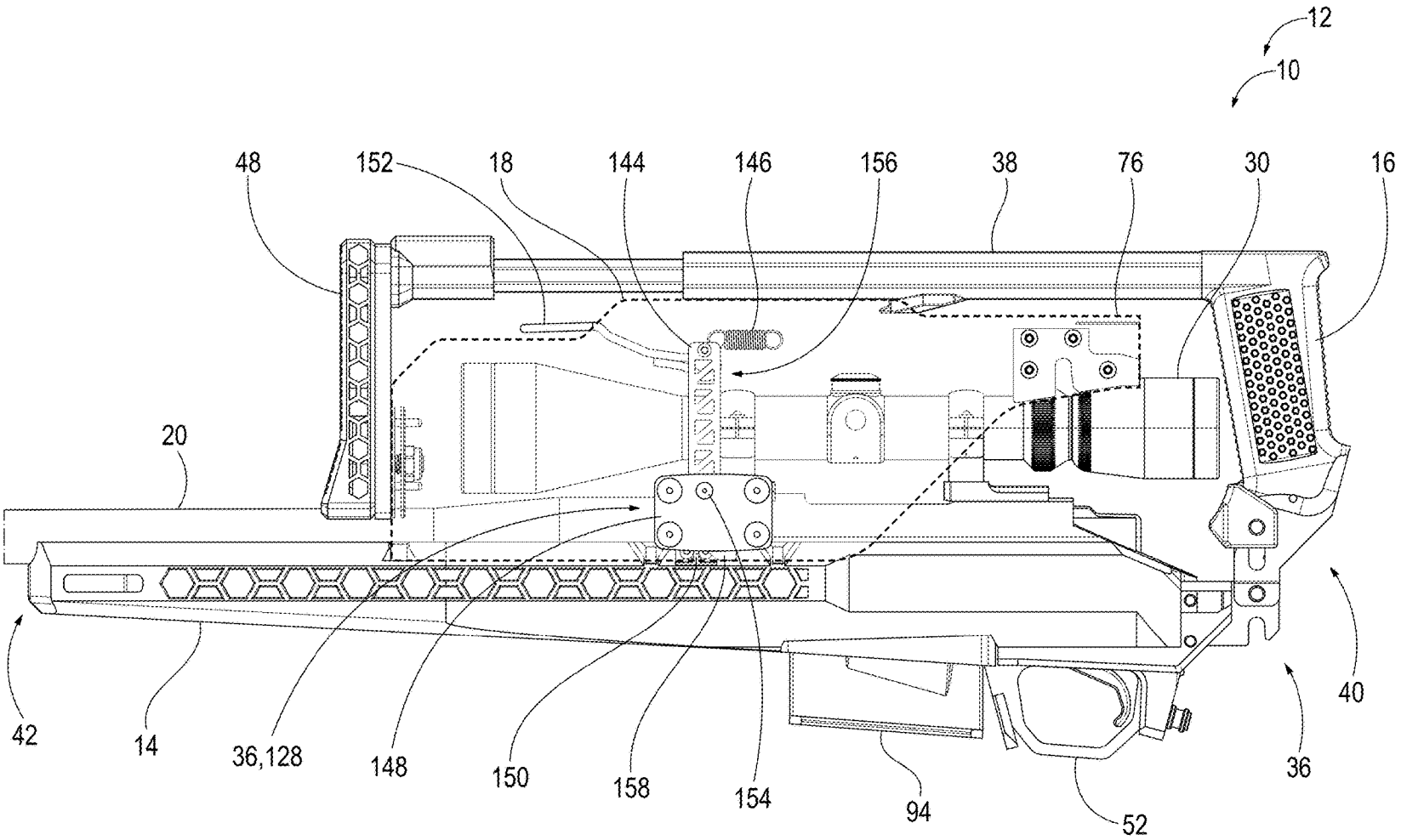
FIG. 30 is a side elevation view of an example of presently disclosed systems, illustrating the stock in the stowed configuration and with the buttstock shown as transparent.
Figure 30A:
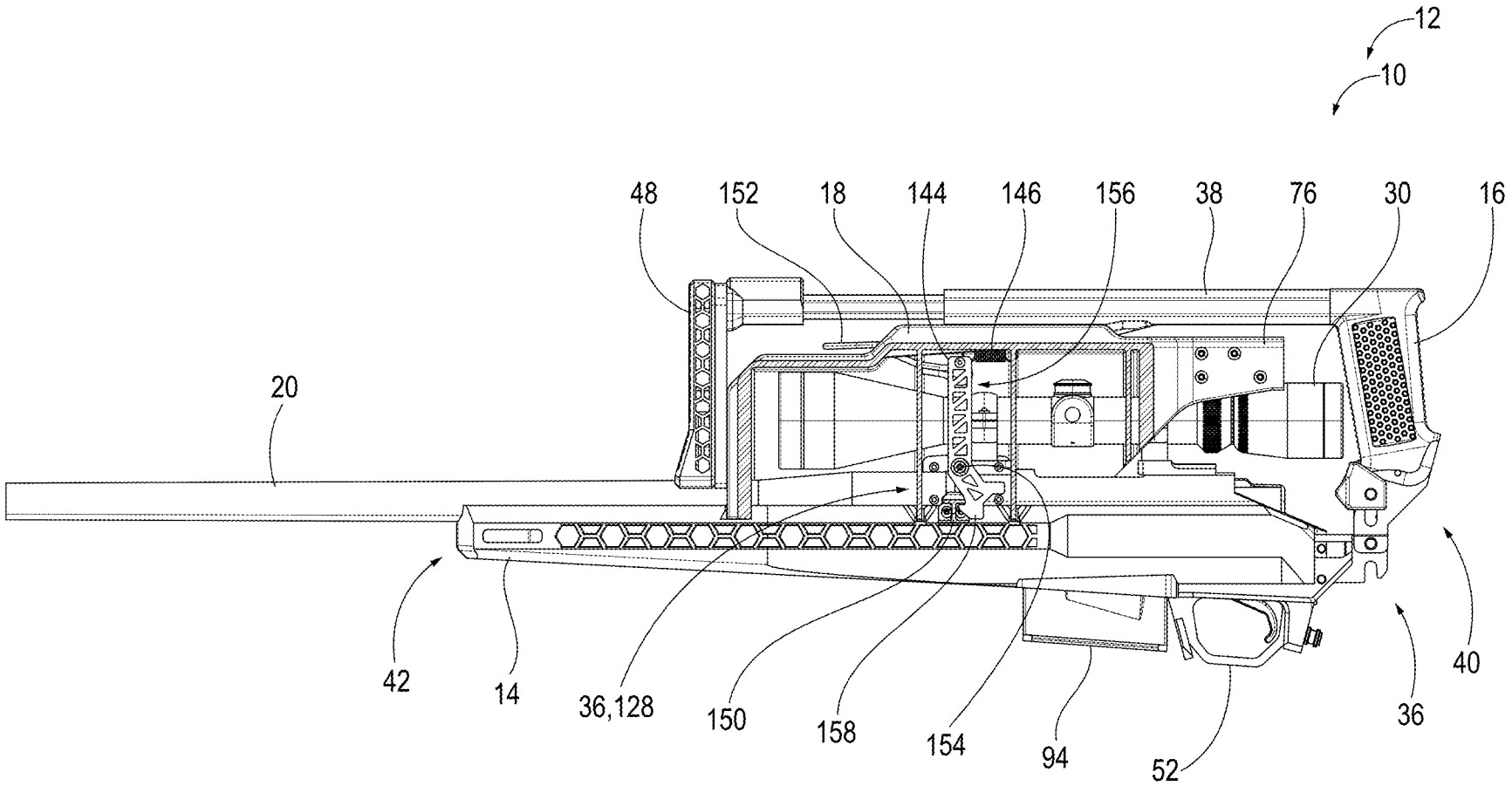
FIG. 30A is a wireframe version of the same, shown in partial cut away.

FIGS. 30 and 30A show an example of forestock latch 128 in which a spring-biased latch pawl 144 is coupled to buttstock 18 (e.g., via a spring 146 and/or a connector plate 148), and a latch catch 150 is coupled to (or integrally formed with) forestock 14. Latch pawl 144, spring 146, and connector plate 148 are generally coupled to inner surface 108 of buttstock 18, such that they are positioned within internal volume 24 of buttstock 18. Latch pawl 144 latches to latch catch 150 when stock 10 is in the stowed configuration (as shown in FIG. 30) to secure buttstock 18 to forestock 14, such that buttstock 18 substantially does not move with respect to forestock 14 in the stowed configuration. Forestock latch 128 may include a pull tab 152 that selectively releases buttstock 18 from forestock 14 when pull tab 152 is actuated. For example, in the latching mechanism 36 of FIG. 30, pulling pull tab 152 causes latch pawl 144 to pivot (e.g., about pin 154) such that an upper portion 156 of latch pawl 144 moves towards distal end 42 of stock 10 and a lower portion 158 of latch pawl 144 moves towards proximal end 40 of stock 10, thereby releasing lower portion 158 from latch catch 150, such that forestock latch 128 is released and buttstock 18 may be moved away from forestock 14 (e.g., to transition stock 10 to or towards the deployed configuration). When pull tab 152 is released, spring 146 pulls latch pawl 144 back towards the position shown in FIG. 30, thereby biasing latch pawl 144 towards the secured position and securing buttstock 18 with respect to forestock 14.

With reference to FIGS. 17, 20, 27, and 28, in some examples of stock 10, buttstock 18 includes one or more vertical fins 160. In some examples, vertical fins 160 are positioned within internal volume 24 of buttstock 18 (e.g., formed in or on inner surface 108 of sidewalls 26, 28). For example, vertical fins 160 may be extrusions or projections extending from inner surface 108 of buttstock 18. In other examples, vertical fins 160 may be extrusions or projections extending from an outer surface 109 of buttstock 18. Said vertical fins 160 may be part of latching mechanism 36 (e.g., part of forestock latch 128). For example, vertical fins 160 may be configured to engage forestock 14 when stock 10 is in the stowed configuration, and thereby constrain buttstock 18 with respect to scope 30 and forestock 14, along a longitudinal axis of the rifle (e.g., along overall length 32 of stock 10). Vertical fins 160 may be included in latching mechanism 36 in addition to or instead of components of other examples disclosed herein. Vertical fins 160 may engage with features in outer surface 64 of forestock 14 when stock 10 is in the stowed configuration. For example, vertical fins 160 may fit into, clip into, mate with, or be received by honeycomb pattern 62, catches 136, or other specially formed mating or receiving features or pockets 164 in forestock 14 (perhaps best seen in FIGS. 3-4) that vertical fins 160 may slide into as buttstock 18 is folded over scope 30 and engaged with forestock 14 in the stowed configuration. In some examples, forestock 14 may include three such pockets 164 on each side of forestock 14, though other examples may include more or fewer pockets 164. Latching mechanism 36 may be configured to hold buttstock 18 down enough such that vertical fins 160 remain engaged with forestock 14 to constrain longitudinal movement of buttstock 18 with respect to forestock 14 in the stowed configuration.

Shoulder end region 80 of buttstock 18 (opposite wrist 76) may be received in a similar manner as vertical fins 160, such as seen in FIG. 27. In some examples, shoulder end region 80 includes a cutout 162 to fit around rifle barrel 68 when stock 10 is in the stowed configuration, as seen in FIG. 17. Thus, buttstock 18 may be in direct contact with forestock 14 in a plurality of different points or locations when buttstock 18 is secured with respect to forestock 14 in the stowed configuration, with movement of buttstock 18 in the stowed configuration being constrained in both the longitudinal direction and the vertical direction by various components of latching mechanism 36. Additionally or alternatively, some or all of sidewalls 26, 28 of buttstock 18 may be secured within pockets 164 or other recesses formed in forestock 14 to secure buttstock 18 longitudinally with respect to forestock 14. These points of contact and vertical fins 160 also may be configured to constrain the sidewalls 26, 28 from collapsing or bowing in and contacting the scope when stock 10 is in the stowed configuration (e.g., substantially preventing or reducing transverse movement of sidewalls 26, 28 towards the scope).

Figure 31:
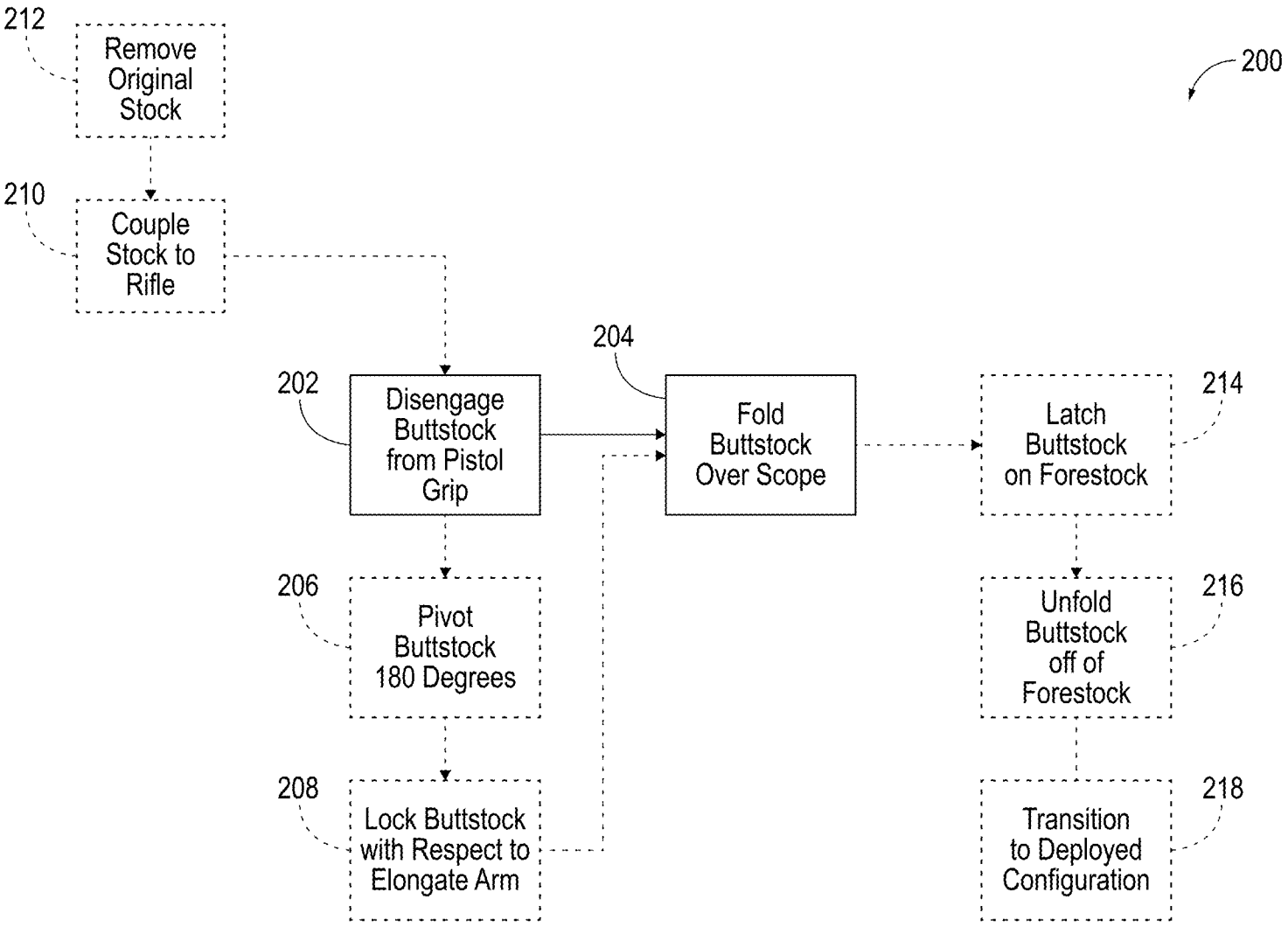
FIG. 31 is a schematic flowchart diagram of methods according to the present disclosure.

FIG. 31 schematically provides a flowchart that represents illustrative, non-exclusive examples of methods 200 according to the present disclosure. In FIG. 31 some steps are illustrated in dashed boxes, indicating that such steps may be optional or may correspond to an optional version of a method according to the present disclosure. That said, not all methods according to the present disclosure are required to include the steps illustrated in solid boxes. The methods and steps illustrated in FIG. 31 are not limiting and other methods and steps are within the scope of the present disclosure, including methods having greater than or fewer than the number of steps illustrated, as understood from the discussions herein.

Methods 200 may include disengaging a buttstock (e.g., buttstock 18) from a grip (e.g., grip 16) of a stock (e.g., stock 10) at 202, and folding the buttstock over a scope at 204, such that at least a portion of the scope is covered by and positioned inside the buttstock, thereby transitioning the stock from a deployed configuration to a stowed configuration. In some examples, the disengaging the buttstock from the grip at 202 includes pulling down on a thumb slide actuator of the stock (e.g., thumb slide actuator 100) to move the stock to an unlocked position. In other examples, different types of actuators may be used to disengage the buttstock from the grip at 202. Disengaging the buttstock from the grip at 202 also may include translating the buttstock proximally away from the grip. Additionally or alternatively, disengaging the buttstock from the grip at 202 may include disengaging a grip slide latch (e.g., grip slide latch 116) from a trigger guard of the stock (e.g., trigger guard 52), thereby causing the grip slide latch to slide off a stud extending from the trigger guard.

Folding the buttstock over the scope at 204 may include causing the grip to pivot or rotate with respect to the forestock. After the buttstock is folded at 204 to the stowed configuration, methods 200 may include latching the buttstock on the forestock at 214, such as via a latching mechanism (e.g., forestock latch 128 of latching mechanism 36) and/or securing a forestock latch (e.g., clipping a spring-biased lever of the buttstock into a recess or catch of the forestock, securing a strap and/or buckle around the forestock, and/or coupling a spring-biased latch pawl of the buttstock to a latch catch of the forestock).

Methods 200 may include pivoting the buttstock with respect to the grip at 206, and in some examples includes pivoting the buttstock substantially 180 degrees with respect to the grip. Doing so may expose the internal volume of the buttstock, to put the buttstock in the desired position to be folded over the rifle scope. Once pivoted at 206, the buttstock may be locked into position with respect to an elongate arm of the stock (e.g., elongate arm 38) at 208. For example, the buttstock may be translated by shortening an extension of the elongate arm to engage a fin on the elongate arm with a recess formed in the buttstock (e.g., to engage fin 54 with recess 56) to lock the position of the buttstock on the elongate arm at 208. The folding of the buttstock at 204 is generally performed after the locking the buttstock with respect to the elongate arm at 208.

From the stowed configuration, methods 200 may include unfolding the buttstock from the scope at 216 and transitioning the stock to the deployed configuration at 218. Unfolding the buttstock at 216 may include disengaging the buttstock from the forestock, such as by pulling a pull tab to release a forestock latch, unclipping a spring-biased lever of the buttstock out of a recess or catch of the forestock, removing a strap and/or buckle from around the forestock, and/or removing a spring-biased latch pawl of the buttstock from a latch catch of the forestock. Unfolding the buttstock at 216 also generally includes pivoting the buttstock and the grip with respect to the forestock. Once unfolded at 216, the transitioning the stock to the deployed configuration at 218 may include re-engaging the buttstock with the grip, such as by translating the buttstock longitudinally towards the grip and moving a thumb slide actuator to a locked position.

In some methods 200, disclosed stocks may be coupled to an existing rifle (e.g., retrofit) by removing the rifle's original stock at 212 and coupling the stock of the present disclosure to the action and barrel of the rifle at 210. Coupling the stock to the rifle at 210 may include fastening the forestock to an action of the rifle and/or fastening a trigger guard of the stock to the action of the rifle. For example, fastening the trigger guard to the action of the rifle may include securing two bolts through the trigger guard and the forestock to secure the stock to the action of the rifle.

Illustrative, non-exclusive examples of inventive subject matter according to the present disclosure are described in the following enumerated paragraphs:

A1. A stock for a firearm, the stock comprising:

a forestock configured to engage with an action of the firearm;

a grip pivotally coupled to the forestock; and a buttstock that defines an internal volume between a first sidewall and a second sidewall, wherein the stock is configured to be selectively transitioned between a deployed configuration and a stowed configuration, wherein in the deployed configuration, the buttstock is engaged with the grip, and wherein in the stowed configuration, the buttstock is disengaged from the grip and engaged with the forestock and positioned such that the internal volume opens towards the forestock, such that the buttstock is configured to at least partially surround a scope of the firearm.

A2. The stock of paragraph A1, further comprising an elongate arm extending from the grip.

A3. The stock of paragraph A2, wherein in the deployed configuration, the elongate arm extends from the grip towards a proximal end of the stock in the deployed configuration.

A4. The stock of any of paragraphs A2-A3, wherein in the deployed configuration, the buttstock is engaged with a first end region of the grip and the elongate arm extends from a second end region of the grip, and wherein the second end region is opposite the first end region.

A5. The stock of any of paragraphs A2-A4, wherein the internal volume of the buttstock faces the elongate arm when the stock is in the deployed configuration.

A6. The stock of any of paragraphs A1-A5, further comprising a butt plate.

A7. The stock of paragraph A6, wherein the buttstock is coupled to the butt plate, such that the buttstock is configured to be selectively pivoted with respect to the butt plate when the buttstock is disengaged from the grip.

A8. The stock of any of paragraphs A6-A7, wherein the buttstock is substantially fixed with respect to the butt plate when the stock is in the deployed configuration.

A9. The stock of any of paragraphs A6-A8, wherein an/the elongate arm of the stock extends from the grip to the butt plate.

A10. The stock of any of paragraphs A1-A9, wherein an/the elongate arm of the stock is telescoping, such that a length of the elongate arm is selectively adjustable.

A11. The stock of paragraph A10, wherein the length of the elongate arm is selectively adjustable when the buttstock is disengaged from the grip.

A12. The stock of any of paragraphs A10-A11, wherein the length of the elongate arm is shortened in the deployed configuration as compared to the length of the elongate arm in the stowed configuration.

A13. The stock of any of paragraphs A1-A12, further comprising a trigger guard engaged with the grip and the forestock, wherein the trigger guard is configured to prevent against unintentional contact with a trigger of the firearm.

A14. The stock of any of paragraphs A1-A13, wherein an overall length of the stock is reduced in the stowed configuration as compared to the deployed configuration.

A15. The stock of any of paragraphs A1-A14, wherein the stock is configured to protect the scope of the firearm from impacts when the stock is in the stowed configuration.

A16. The stock of any of paragraphs A1-A15, wherein the stock comprises a rigid or semi-rigid material.

A17. The stock of any of paragraphs A1-A16, wherein the stock is configured to completely cover the scope of the firearm when the stock is in the stowed configuration.

A18. The stock of any of paragraphs A1-A17, wherein the first sidewall and the second sidewall of the buttstock do not contact the scope of the firearm when the stock is in the stowed configuration.

A19. The stock of any of paragraphs A1-A18, wherein the buttstock comprises a top wall extending between the first sidewall and the second sidewall, and wherein the stock is configured such that the top wall does not contact the scope of the firearm when the stock is in the stowed configuration.

A20. The stock of any of paragraphs A1-A19, wherein the buttstock is configured to surround at least one attachment point coupling the scope to the firearm.

A21. The stock of any of paragraphs A1-A20, wherein the stock is configured such that the firearm and the stock can be stowed in a backpack or a sling when the stock is in the stowed configuration.

A22. The stock of any of paragraphs A1-A21, further comprising a latching mechanism.

A23. The stock of paragraph A22, wherein the latching mechanism is configured to secure the stock in the deployed configuration.

A24. The stock of any of paragraphs A22-A23, wherein the latching mechanism is configured to secure the stock in the stowed configuration.

A25. The stock of any of paragraphs A22-A24, wherein the latching mechanism is configured to resist a recoil of the firearm when in use, such that the latching mechanism remains secure when the firearm is fired.

A26. The stock of any of paragraphs A22-A25, wherein the latching mechanism comprises a quick-release mechanism to enable transitioning of the stock from the deployed configuration to the stowed configuration.

A27. The stock of any of paragraphs A22-A26, wherein the latching mechanism comprises a thumb slide actuator.

A28. The stock of paragraph A27, wherein the thumb slide actuator is positioned at least partially within the buttstock when the stock is in the deployed configuration.

A29. The stock of paragraph A28, wherein the thumb slide actuator is positioned at least partially within a wrist of the buttstock when the stock is in the deployed configuration.

A30. The stock of any of paragraphs A27-A29, wherein the thumb slide actuator is selectively movable between a locked position and an unlocked position.

A30.1. The stock of paragraph A30, wherein the thumb slide actuator is in the locked position when the stock is in the deployed configuration.

A30.2. The stock of paragraph A30 or A30.1, wherein the thumb slide actuator must be moved to the unlocked position to release the buttstock from the grip before the stock can be transitioned to the stowed configuration.

A31. The stock of any of paragraphs A27-A30.2, wherein the thumb slide actuator disengages or unlocks the buttstock from the grip when the thumb slide actuator is pulled down to an/the unlocked position.

A31.1. The stock of any of paragraphs A27-A31, wherein the thumb slide actuator engages or locks the buttstock to the grip when the thumb slide actuator is pushed up to a/the locked position.

A32. The stock of any of paragraphs A27-A31.1, wherein the thumb slide actuator comprises a locking pin.

A33. The stock of paragraph A32, wherein the locking pin has a longitudinal pin axis that is substantially perpendicular to a longitudinal buttstock axis of the buttstock.

A34. The stock of paragraph A32 or A33, wherein the locking pin is substantially orthogonal to a longitudinal forestock axis of the forestock.

A35. The stock of any of paragraphs A32-A34, wherein the thumb slide actuator is integrally formed with the locking pin.

A36. The stock of any of paragraphs A32-A35, wherein movement of the thumb slide actuator causes corresponding movement of the locking pin.

A37. The stock of any of paragraphs A32-A36, wherein when the thumb slide actuator is in a/the locked position, the locking pin extends through a wrist slot formed in or inside the buttstock.

A37.1. The stock of paragraph A37, wherein the wrist slot comprises a first slot portion formed on a first inner surface of the first sidewall and a second slot portion formed on a second inner surface of the second sidewall.

A37.2. The stock of paragraph A37 or A37.1, wherein the wrist slot is positioned within a distal portion of the buttstock.

A38. The stock of any of paragraphs A32-A37.2, wherein when the thumb slide actuator is in an/the unlocked position, the locking pin is positioned outside of a/the wrist slot of the buttstock.

A39. The stock of any of paragraphs A32-A38, wherein the a/the wrist slot of the buttstock comprises a ramp, and wherein movement of the locking pin into the wrist slot forces movement of the buttstock towards the forestock and thereby towards a/the distal end of the buttstock via the ramp.

A40. The stock of paragraph A39, wherein movement of the locking pin along the ramp and into the wrist slot causes the buttstock to engage with the grip and/or the forestock.

A41. The stock of any of paragraphs A27-A40, wherein when the thumb slide actuator is in an/the unlocked position, the grip is disengaged from a/the trigger guard of the stock.

A41.1. The stock of any of paragraphs A32-A41, wherein the locking pin of the thumb slide actuator is positioned within a bracket slot when the thumb slide actuator is in a/the locked position, and wherein the bracket slot is formed in a bracket that pivotally couples the grip to the forestock.

A41.2. The stock of paragraph A41.1, wherein the locking pin is positioned outside of the bracket slot when the thumb slide actuator is in an/the unlocked position.

A41.3. The stock of paragraph A41.1 or A41.2, wherein the bracket slot is ramped such that the bracket slot is configured to draw the grip against the forestock and a/the trigger guard when the thumb slide actuator is in the locked position.

A42. The stock of any of paragraphs A22-A41.3, wherein the latching mechanism comprises a grip slide latch.

A43. The stock of paragraph A42, wherein movement of a/the thumb slide actuator to an/the unlocked position causes the grip slide latch to disengage from a/the trigger guard of the stock.

A44. The stock of paragraph A42 or A43, wherein movement of a/the thumb slide actuator to an/the unlocked position causes the grip slide latch to slide off of a stud extending from a/the trigger guard of the stock.

A45. The stock of any of paragraphs A1-A44, wherein the stock is configured to be transitioned to the stowed configuration by translating the buttstock away from the grip and the forestock.

A45.1. The stock of any of paragraphs A1-A45, wherein the buttstock is configured to be translated away from the grip and the forestock when a/the wrist of the buttstock is disengaged from the grip.

A45.2. The stock of paragraph A45.1, wherein when the wrist is disengaged from the grip, the buttstock is still operatively coupled to the grip via an/the elongate arm extending from the grip and via a/the butt plate coupled to a shoulder end region of the buttstock and to the elongate arm.

A45.3. The stock of paragraph A45.2, wherein the shoulder end region of the buttstock is opposite the wrist of the buttstock.

A46. The stock of any of paragraphs A45-A45.3, wherein an/the elongate arm extends in length to accommodate translating the buttstock away from the grip and the forestock.

A47. The stock of any of paragraphs A45-A46, wherein a/the butt plate of the stock is translated away from the grip and the forestock when the buttstock is translated away from the grip and the forestock.

A48. The stock of any of paragraphs A1-A47, wherein the stock is configured to be transitioned to the stowed configuration by pivoting the buttstock with respect to the forestock, the grip, an/the elongate arm, and/or a/the butt plate.

A49. The stock of any of paragraphs A1-A48, wherein the buttstock is configured to be pivoted with respect to the forestock, the grip, an/the elongate arm, and/or a/the butt plate when a/the wrist of the buttstock is disengaged from the grip.

A50. The stock of paragraph A48 or A49, wherein the buttstock is configured to pivot by at least 180 degrees with respect to the forestock, the grip, the elongate arm, and/or the butt plate.

A51. The stock of any of paragraphs A1-A50, wherein the buttstock is configured to be pivoted between a first orientation and a second orientation, wherein in the first orientation, the internal volume of the buttstock faces an/the elongate arm extending from the grip, and wherein in the second orientation, the internal volume of the buttstock faces away from the elongate arm.

A52. The stock of paragraph A51, wherein the elongate arm comprises a fin or projection extending from the elongate arm, wherein the buttstock comprises a recess configured to receive the fin or projection, and wherein the buttstock is configured to slide along the elongate arm while the buttstock is in the second orientation to engage the fin or projection with the recess, thereby locking the buttstock in position with respect to the elongate arm.

A53. The stock of any of paragraphs A1-A52, wherein the grip is configured to pivot with respect to the forestock when a/the grip slide latch is released or disengaged from a/the stud of a/the trigger guard.

A54. The stock of any of paragraphs A1-A53, wherein the grip is configured to pivot substantially 180 degrees with respect to the forestock between the deployed configuration and the stowed configuration.

A55. The stock of any of paragraphs A1-A54, wherein a/the thumb slide latch operatively coupled to the grip faces a/the proximal end of the stock when the stock is in the deployed configuration, and wherein a/the thumb slide latch faces a distal end of the stock when the stock is in the stowed configuration.

A56. The stock of any of paragraphs A1-A55, wherein the buttstock is folded over and/or onto at least a portion of the scope of the firearm as the stock is transitioned from the deployed configuration to the stowed configuration.

A57. The stock of any of paragraphs A1-A56, wherein a/the latching mechanism of the stock comprises a forestock latch configured to secure the buttstock to the forestock when the stock is in the stowed configuration.

A58. The stock of paragraph A57, wherein the forestock latch comprises a spring-biased lever arm that clips into a recess or groove of the forestock.

A58.1. The stock of paragraph A58, wherein a portion of the spring-biased lever arm extends through an aperture of the buttstock to create a button configured to be actuated to release the spring-biased lever arm from a catch on the forestock.

A59. The stock of any of paragraphs A57-A58.1, wherein the forestock latch comprises a strap and/or buckle configured to secure the buttstock to the forestock when the stock is in the stowed configuration.

A60. The stock of any of paragraphs A57-A59, wherein the forestock latch comprises: a spring-biased latch pawl coupled to the buttstock; and a latch catch coupled to the forestock, wherein the spring-biased latch pawl latches to the latch catch when the stock is in the stowed configuration.

A61. The stock of any of paragraphs A57-A60, wherein the forestock latch comprises a pull tab that selectively releases the buttstock from the forestock when the pull tab is actuated.

A62. The stock of any of paragraphs A1-A61, wherein the buttstock comprises a plurality of vertical fins configured to engage the forestock when the stock is in the stowed configuration, and thereby constrain the buttstock with respect to the scope, along a longitudinal axis of the firearm.

A63. The stock of any of paragraphs A1-A62, wherein the stock is configured to be modular and adaptable to a plurality of different firearms.

A64. The stock of any of paragraphs A1-A63, wherein the forestock is configured to bolt to the action of the firearm.

A65. The stock of any of paragraphs A1-A64, wherein the forestock serves as a pivot point for folding the stock to the stowed configuration, and wherein the forestock serves as a latching point when the stock is in the stowed position.

A66. The stock of any of paragraphs A1-A65, comprising a pivot pin extending through the grip and the forestock, wherein the grip pivots about the pivot pin with respect to the forestock to transition the stock between the deployed configuration and the stowed configuration.

A67. The stock of any of paragraphs A1-A66, wherein the forestock comprises a nesting recess configured to receive a recoil lug of the firearm.

A68. The stock of any of paragraphs A1-A66, wherein the forestock comprises trussing on an inner surface of the forestock, wherein the trussing is configured for imparting rigidity and weight-reduction to the forestock.

A69. The stock of any of paragraphs A1-A68, wherein the forestock comprises a honeycomb pattern on an outer surface of the forestock configured to reduce a weight of the forestock.

B1. A system, comprising:

the stock of any of paragraphs A1-A69; and the firearm.

B2. The system of paragraph B1, further comprising a backpack configured to store and transport the stock and the firearm when the stock is in the stowed configuration.

B3. The system of any of paragraphs B1-B2, further comprising a sling configured to transport the stock and the firearm.

B4. The system of any of paragraphs B1-B3, wherein the firearm comprises a rifle, a shot gun, and/or a long gun.

C1. A method, comprising:

disengaging a buttstock from a grip; and folding the buttstock of the stock of any of paragraphs A1-A69 over the scope such that at least a portion of the scope is covered by and positioned inside the buttstock, thereby placing the buttstock in the stowed configuration.

C2. The method of paragraph C1, wherein the disengaging the buttstock from the grip comprises pulling down on a/the thumb slide actuator to move into a/the unlocked position.

C3. The method of any of paragraphs C1-C2, wherein the disengaging the buttstock from the grip comprises translating the buttstock proximally away from the grip.

C3.1. The method of any of paragraphs C1-C3, wherein the disengaging the buttstock from the grip comprises disengaging a/the grip slide latch from a/the trigger guard of the stock, thereby causing the grip slide latch to slide off a/the stud extending from the trigger guard.

C4. The method of any of paragraphs C1-C3.1, further comprising pivoting the buttstock by 180 degrees with respect to the grip.

C5. The method of paragraph C4, further comprising locking the buttstock with respect to an/the elongate arm of the stock after the pivoting the buttstock.

C6. The method of paragraph C5, wherein the folding the buttstock is performed after the locking the buttstock with respect to the elongate arm.

C7. The method of any of paragraphs C1-C6, further comprising coupling the stock to the firearm.

C8. The method of paragraph C7, wherein the coupling the stock to the firearm comprises fastening the forestock to the action of the firearm.

C9. The method of paragraph C8, further comprising fastening a/the trigger guard of the stock to the action of the firearm.

C10. The method of paragraph C9, wherein the fastening the trigger guard comprises securing two bolts through the trigger guard and the forestock to secure the stock to the action of the firearm.

C11. The method of any of paragraphs C1-C10, further comprising removing an original stock of the firearm and replacing it with the stock of any of paragraphs A1-A69.

C12. The method of any of paragraphs C1-C11, wherein the folding the buttstock over the scope causes the grip to pivot or rotate with respect to the forestock.

C13. The method of any of paragraphs C1-C12, further comprising latching the buttstock on the forestock of the stock after the folding the buttstock over the scope.

C14. The method of paragraph C13, wherein the latching the buttstock on the forestock comprises securing a/the forestock latch.

C15. The method of paragraph C14, wherein the securing the forestock latch comprises clipping a/the spring-biased lever into a/the recess or groove of the forestock.

C16. The method of paragraph C14 or C15, wherein the securing the forestock latch comprises securing a/the strap and/or buckle around the forestock.

C17. The method of any of paragraphs C14-C16, wherein the securing the forestock latch comprises coupling a/the spring-biased latch pawl of the buttstock to a/the latch catch of the forestock.

C18. The method of any of paragraphs C1-C17, further comprising unfolding the buttstock from the scope and transitioning the stock to the deployed configuration.

C19. The method of paragraph C18, wherein the unfolding the buttstock comprises disengaging the buttstock from the forestock.

C20. The method of paragraph C19, wherein the disengaging the buttstock from the forestock comprises pulling a/the pull tab to release a/the forestock latch.

C21. The method of any of paragraphs C18-C20, wherein the unfolding the buttstock comprises pivoting the buttstock and the grip with respect to the forestock.

C22. The method of any of paragraphs C18-C21, wherein the transitioning the stock to the deployed configuration comprises engaging the buttstock with the grip.

C23. The method of paragraph C22, wherein the engaging the buttstock with the grip comprises moving the thumb slide actuator to a/the locked position.

D1. The use of the stock of any of paragraphs A1-A69 to cover and/or protect a firearm scope.

As used herein, the terms "selective" and "selectively," when modifying an action, movement, configuration, or other activity of one or more components or characteristics of an apparatus, mean that the specific action, movement, configuration, or other activity is a direct or indirect result of dynamic processes and/or user manipulation of an aspect of, or one or more components of, the apparatus. The terms "selective" and "selectively" thus may characterize an activity that is a direct or indirect result of user manipulation of an aspect of, or one or more components of, the apparatus, or may characterize a process that occurs automatically, such as via the mechanisms disclosed herein.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one example, to at least one, optionally including more than one, A, with no B present (and optionally including entities other than B); in another example, to at least one, optionally including more than one, B, with no A present (and optionally including entities other than A); in yet another example, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, or A, B, and C together, and optionally any of the above in combination with at least one other entity.

As used herein, the phrase "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, a first direction that is at least substantially parallel to a second direction includes a first direction that is within an angular deviation of 22.5° relative to the second direction and also includes a first direction that is identical to the second direction.

Surfaces depicted as contacting each other in the Figures may be in direct contact. The term "on" may refer to face-sharing contact.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

As used herein, the phrase, "for example," the phrase, "as an example," and/or simply the term "example," when used with reference to one or more components, features, details, structures, examples, and/or methods according to the present disclosure, are intended to convey that the described component, feature, detail, structure, example, and/or method is an illustrative, non-exclusive example of components, features, details, structures, examples, and/or methods according to the present disclosure. Thus, the described component, feature, detail, structure, example, and/or method is not intended to be limiting, required, or exclusive/exhaustive; and other components, features, details, structures, examples, and/or methods, including structurally and/or functionally similar and/or equivalent components, features, details, structures, examples, and/or methods, are also within the scope of the present disclosure.

The invention claimed is:

1. A stock for a firearm, the stock comprising:

a forestock configured to engage with an action of the firearm;

a grip directly and pivotally coupled to the forestock; and a buttstock that defines an internal volume between a first sidewall and a second sidewall, wherein the stock is configured to be selectively transitioned between a deployed configuration and a stowed configuration, wherein in the deployed configuration, the buttstock is engaged with the grip, and wherein in the stowed configuration, the buttstock is disengaged from the grip and engaged with the forestock and positioned such that the internal volume opens towards the forestock, such that the buttstock is configured to at least partially surround a scope of the firearm.

2. The stock according to claim 1, further comprising an elongate arm extending from the grip, wherein in the deployed configuration, the elongate arm extends from the grip towards a proximal end of the stock, wherein in the deployed configuration, the buttstock is engaged with a first end region of the grip and the elongate arm extends from a second end region of the grip, wherein the second end region is opposite the first end region, and wherein the elongate arm is telescoping, such that a length of the elongate arm is selectively adjustable.

3. The stock according to claim 2, wherein the elongate arm comprises a projection extending from the elongate arm, wherein the buttstock comprises a recess configured to receive the projection, and wherein the buttstock is configured to slide along the elongate arm while the buttstock is in a second orientation to engage the projection with the recess, thereby locking the buttstock in position with respect to the elongate arm, and wherein the buttstock is in a first orientation in the deployed configuration, the first orientation of the buttstock relative to the elongate arm being different from the second orientation.

4. The stock according to claim 2, further comprising a butt plate, wherein the buttstock is coupled to the butt plate, such that the buttstock is configured to be selectively pivoted with respect to the butt plate when the buttstock is disengaged from the grip, wherein the buttstock is substantially fixed with respect to the butt plate when the stock is in the deployed configuration, and wherein the elongate arm extends from the grip to the butt plate.

5. The stock according to claim 1, wherein an overall length of the stock is reduced in the stowed configuration as compared to the deployed configuration.

6. The stock according to claim 1, wherein the stock is configured to protect the scope of the firearm from impacts when the stock is in the stowed configuration, wherein the first sidewall and the second sidewall of the buttstock do not contact the scope of the firearm when the stock is in the stowed configuration, wherein the buttstock comprises a top wall extending between the first sidewall and the second sidewall, and wherein the stock is configured such that the top wall does not contact the scope of the firearm when the stock is in the stowed configuration.

7. The stock according to claim 1, further comprising a latching mechanism, wherein the latching mechanism is configured to secure the stock in at least one of the deployed configuration and the stowed configuration.

8. The stock according to claim 7, wherein the latching mechanism comprises a quick-release mechanism to enable transitioning of the stock from the deployed configuration to the stowed configuration.

9. The stock according to claim 7, wherein the latching mechanism comprises a thumb slide actuator, wherein the thumb slide actuator is positioned at least partially within the buttstock when the stock is in the deployed configuration, wherein the thumb slide actuator is selectively movable between a locked position and an unlocked position, wherein the thumb slide actuator is in the locked position when the stock is in the deployed configuration, wherein the thumb slide actuator must be moved to the unlocked position to release the buttstock from the grip before the stock can be transitioned to the stowed configuration.

10. The stock according to claim 9, wherein the thumb slide actuator comprises a locking pin, wherein movement of the thumb slide actuator causes corresponding movement of the locking pin, wherein when the thumb slide actuator is in the locked position, the locking pin extends through a wrist slot formed in or inside the buttstock, and wherein when the thumb slide actuator is in the unlocked position, the locking pin is positioned outside of the wrist slot of the buttstock.

11. The stock according to claim 9, wherein the latching mechanism comprises a grip slide latch, wherein movement of the thumb slide actuator to the unlocked position causes the grip slide latch to disengage from a trigger guard of the stock by causing the grip slide latch to slide off of a stud extending from the trigger guard of the stock.

12. The stock according to claim 7, wherein the latching mechanism of the stock comprises a forestock latch configured to secure the buttstock to the forestock when the stock is in the stowed configuration.

13. The stock according to claim 1, wherein the stock is configured to be transitioned to the stowed configuration by translating the buttstock away from the grip and the forestock, wherein the buttstock is configured to be translated away from the grip and the forestock when a wrist of the buttstock is disengaged from the grip, wherein when the wrist is disengaged from the grip, the buttstock is still operatively coupled to the grip via an elongate arm extending from the grip and via a butt plate coupled to a shoulder end region of the buttstock and to the elongate arm, and wherein the elongate arm extends in length to accommodate translating the buttstock away from the grip and the forestock.

14. The stock according to claim 1, wherein the stock is configured to be transitioned to the stowed configuration by pivoting the buttstock with respect to the forestock and the grip, and wherein the buttstock is folded over at least a portion of the scope of the firearm as the stock is transitioned from the deployed configuration to the stowed configuration.

15. The stock according to claim 1, wherein the buttstock comprises a plurality of vertical fins configured to engage the forestock when the stock is in the stowed configuration, and thereby constrain the buttstock with respect to the scope, along a longitudinal axis of the firearm.

16. A system, comprising:

the stock according to claim 1; and the firearm.

17. The system according to claim 16, further comprising a backpack configured to store and transport the stock and the firearm when the stock is in the stowed configuration.

18. A method, comprising:

disengaging the buttstock of the stock according to claim 1 from the grip; and folding the buttstock over the scope such that at least a portion of the scope is covered by and positioned inside the buttstock, thereby placing the buttstock in the stowed configuration.

19. The method according to claim 18, wherein the disengaging the buttstock from the grip comprises:

pulling down on a thumb slide actuator to move into an unlocked position; and translating the buttstock proximally away from the grip.

20. The method according to claim 18, further comprising:

pivoting the buttstock by about 180 degrees with respect to the grip;

locking the buttstock with respect to an elongate arm of the stock after the pivoting the buttstock, wherein the folding the buttstock is performed after the locking the buttstock with respect to the elongate arm; and latching the buttstock on the forestock of the stock after the folding the buttstock over the scope.

* * * * *